US008553055B1

(12) United States Patent
Martell et al.

(10) Patent No.: US 8,553,055 B1
(45) Date of Patent: Oct. 8, 2013

(54) THERMAL PRINTER OPERABLE TO SELECTIVELY CONTROL THE DELIVERY OF ENERGY TO A PRINT HEAD OF THE PRINTER AND METHOD

(75) Inventors: Robert W. Martell, Portland, OR (US); Mark E. Thueson, Ogden, UT (US)

(73) Assignee: Graphic Products, Inc., Beaverton, OR (US)

( * ) Notice: Subject to any disclaimer, the term of this patent is extended or adjusted under 35 U.S.C. 154(b) by 52 days.

(21) Appl. No.: 13/426,499

(22) Filed: Mar. 21, 2012

Related U.S. Application Data

(63) Continuation-in-part of application No. 13/366,182, filed on Feb. 3, 2012, now Pat. No. 8,482,586, and a continuation-in-part of application No. 13/371,833, filed on Feb. 13, 2012, now Pat. No. 8,477,162.

(60) Provisional application No. 61/553,016, filed on Oct. 28, 2011, provisional application No. 61/577,550, filed on Dec. 19, 2011.

(51) Int. Cl.
*B41J 2/00* (2006.01)

(52) U.S. Cl.
USPC ..... 347/192

(58) Field of Classification Search
USPC ..... 347/171, 191, 192, 211, 214, 222; 400/693
See application file for complete search history.

(56) References Cited

U.S. PATENT DOCUMENTS

| | | | |
|---|---|---|---|
| 3,634,726 | A | 1/1972 | Jay |
| 4,110,810 | A | 8/1978 | Moore et al. |
| 4,214,211 | A | 7/1980 | Yokogawa |
| 4,434,354 | A | 2/1984 | Nakata |
| 4,442,342 | A | 4/1984 | Yoneda |
| 4,494,166 | A | 1/1985 | Billings et al. |
| 4,517,143 | A | 5/1985 | Kisler |
| 4,523,252 | A | 6/1985 | Wallén |
| 4,573,058 | A | 2/1986 | Brooks |
| 4,602,311 | A | 7/1986 | Lloyd et al. |
| 4,707,153 | A | 11/1987 | Nishi et al. |
| 4,717,059 | A | 1/1988 | Takahashi |
| 4,760,492 | A | 7/1988 | Walsh |
| 4,810,432 | A | 3/1989 | Kisler |
| 4,918,464 | A | 4/1990 | Isshiki |
| 4,980,009 | A | 12/1990 | Goodwin et al. |
| 5,084,831 | A | 1/1992 | Morikawa et al. |
| 5,095,400 | A | 3/1992 | Saito |
| 5,132,701 | A | 7/1992 | Stephenson et al. |
| 5,140,341 | A | 8/1992 | Fiscella et al. |
| 5,179,497 | A | 1/1993 | Bakhoum |
| 5,247,420 | A | 9/1993 | Bakhoum |
| 5,280,646 | A | 1/1994 | Koyama et al. |
| 5,321,627 | A | 6/1994 | Reher |
| 5,359,750 | A | 11/1994 | Le Vantine |
| 5,432,533 | A | 7/1995 | Shibamiya |

(Continued)

*Primary Examiner* — Kristal Feggins

(74) *Attorney, Agent, or Firm* — Klarquist Sparkman, LLP

(57) ABSTRACT

A thermal printer is operated to adjust the level of energy applied to print elements of a print head of the printer in response to selected changes in signals corresponding to the voltage from a power source used to provide energy to the printing elements. Voltage changes that occur during printing of a print can be ignored. In addition, voltage changes occurring when a printer is not being powered by a battery can also be ignored. Rapid decreases in voltage of the power source can be detected and accounted for. In addition, increasing voltages of the power source can also be determined and accounted for.

24 Claims, 16 Drawing Sheets

(56) References Cited

U.S. PATENT DOCUMENTS

| | | | | |
|---|---|---|---|---|
| 5,469,322 | A | 11/1995 | Seo | |
| RE35,214 | E | 4/1996 | McGarry et al. | |
| 5,515,087 | A | 5/1996 | Lim et al. | |
| 5,551,785 | A | 9/1996 | Mori et al. | |
| 5,563,496 | A | 10/1996 | McClure | |
| 5,606,242 | A | 2/1997 | Hull et al. | |
| 5,606,243 | A | 2/1997 | Sakai et al. | |
| 5,611,631 | A | 3/1997 | Ooishi et al. | |
| 5,617,324 | A | 4/1997 | Arai | |
| 5,659,349 | A | 8/1997 | Albano et al. | |
| 5,669,720 | A | 9/1997 | Negishi et al. | |
| 5,673,070 | A | 9/1997 | Nakanishi et al. | |
| 5,682,504 | A | 10/1997 | Kimura et al. | |
| 5,703,469 | A | 12/1997 | Kinoshita | |
| 5,719,739 | A | 2/1998 | Horiguchi | |
| 5,745,146 | A | 4/1998 | Durst et al. | |
| 5,811,890 | A | 9/1998 | Hamamoto | |
| 5,835,107 | A | 11/1998 | Suzuki et al. | |
| 5,840,452 | A | 11/1998 | Kitagawa | |
| 5,844,884 | A | 12/1998 | Szlenski | |
| 6,095,700 | A | 8/2000 | Negishi et al. | |
| 6,120,864 | A | 9/2000 | Chiricosta et al. | |
| 6,134,016 | A | 10/2000 | Watanabe et al. | |
| 6,167,330 | A | 12/2000 | Linderman | |
| 6,169,387 | B1 | 1/2001 | Kaib | |
| 6,232,747 | B1 | 5/2001 | Takahashi et al. | |
| 6,247,860 | B1 | 6/2001 | Yanagisawa | |
| 6,359,419 | B1 | 3/2002 | Verbrugge et al. | |
| 6,405,012 | B2 | 6/2002 | Ishikawa | |
| 6,444,102 | B1 | 9/2002 | Tucci et al. | |
| 6,515,464 | B1 | 2/2003 | Darmawaskita et al. | |
| 6,532,078 | B2 | 3/2003 | Hayama | |
| 6,549,947 | B1 | 4/2003 | Suzuki | |
| 6,647,242 | B2 | 11/2003 | Gagnon et al. | |
| 6,739,530 | B1 | 5/2004 | Shilton et al. | |
| 6,784,908 | B2 | 8/2004 | Shibuya | |
| 6,918,645 | B2 | 7/2005 | Takahashi | |
| 6,919,443 | B1 | 7/2005 | Takahashi | |
| 6,952,555 | B2 | 10/2005 | Oh et al. | |
| 6,961,075 | B2 | 11/2005 | Mindler et al. | |
| 7,014,375 | B2 | 3/2006 | Nagae et al. | |
| 7,052,105 | B2 | 5/2006 | Ushigome | |
| 7,206,010 | B2 * | 4/2007 | Maghakian | 347/214 |
| 7,235,949 | B2 | 6/2007 | Ikeda | |
| 7,307,592 | B2 | 12/2007 | Park et al. | |
| 7,330,802 | B2 | 2/2008 | Hsu | |
| 7,342,381 | B2 | 3/2008 | Johnson et al. | |
| 7,589,650 | B2 | 9/2009 | Hsien et al. | |
| 7,696,725 | B2 | 4/2010 | Liu et al. | |
| 7,711,401 | B2 | 5/2010 | Lim | |
| 7,768,233 | B2 | 8/2010 | Lin et al. | |
| 7,812,747 | B2 | 10/2010 | Chen | |
| 7,924,088 | B1 | 4/2011 | Chiang et al. | |
| 7,983,863 | B2 | 7/2011 | Jin et al. | |
| 8,032,040 | B2 | 10/2011 | Lee | |
| 8,342,763 | B2 * | 1/2013 | Vo et al. | 400/693 |
| 2002/0057458 | A1 | 5/2002 | Davis et al. | |
| 2003/0007180 | A1 | 1/2003 | Urasawa et al. | |
| 2005/0231583 | A1 * | 10/2005 | Maghakian | 347/191 |
| 2010/0165406 | A1 | 7/2010 | Purnomo | |

* cited by examiner

THERMAL PRINTER OPERABLE TO SELECTIVELY CONTROL THE DELIVERY OF ENERGY TO A PRINT HEAD OF THE PRINTER AND METHOD

CROSS REFERENCE TO RELATED APPLICATIONS

This application claims the benefit of U.S. Provisional Application Ser. No. 61/553,016, entitled THERMAL PRINTER WITH STATIC ELECTRICITY DISCHARGER, filed on Oct. 28, 2011, and the benefit of U.S. Provisional Application Ser. No. 61/577,550, entitled THERMAL PRINTER OPERABLE TO SELECTIVELY PRINT SUB-BLOCKS OF PRINT DATA AND METHOD, filed on Dec. 19, 2011, and is a continuation in part of U.S. patent application Ser. No. 13/366,182, entitled THERMAL PRINTER OPERABLE TO SELECTIVELY PRINT SUB-BLOCKS OF PRINT DATA AND METHOD, filed Feb. 3, 2012, now U.S. Pat. No. 8,482,586 and is also a continuation in part of U.S. patent application Ser. No. 13/371,833, entitled THERMAL PRINTER WITH STATIC ELECTRICITY DISCHARGER, filed Feb. 13, 2012, now U.S. Pat. No. 8,477,162 all of which applications are incorporated by reference herein.

TECHNICAL FIELD

This disclosure relates to thermal printers for printing a substrate.

BACKGROUND

A typical thermal printer transfers ink, such as from an ink transfer ribbon, to a substrate to print the substrate. The substrate has first and second opposed major surfaces that are movable through the printer in a downstream direction along a print flow path, it being understood that the print flow path need not be straight. A thermal print head in the print flow path has heater elements operable in response to energy delivered thereto to heat the ink transfer ribbon to transfer ink to the substrate at a print location as the ink transfer ribbon and substrate travel relative to the thermal print head along the print flow path. The printer controller can be coupled to a cutter to control the cutter to sever the substrate following printing of print data onto the substrate.

In one known approach, a thermal printer supplies energy to the print head heater elements of a thermal print head to heat these elements to cause a transfer of ink from an ink transfer ribbon to a substrate to thereby print the substrate. These elements can each be a single pixel positioned in a print array with selected elements being heated to print the desired image on the substrate. The amount of energy required to produce a print of an acceptable quality can depend upon the type of ink transfer ribbon and substrate being used in printing. A common form of printer utilizes one set of print head energy settings for each ribbon/substrate combination that requires a different amount of energy for an acceptable print. Thus, for a specific ribbon/substrate combination a corresponding print head energy setting is used to, in theory, result in the desired amount of energy being applied to the heating elements during printing. However, if a printer is in a battery mode of operation, wherein one or more batteries are being used to supply energy for printing, the printer places a substantial current draw on available battery energy. Discharge of the battery can lead to an insufficient amount of energy being provided to the print head heater elements to produce a print of acceptable quality.

Therefore, a need exists for an improved thermal printer that can be powered by a battery and provide high quality prints, even as the battery voltage drops.

SUMMARY

In accordance with one aspect of this disclosure, when the power available from a battery for printing drops, the energy delivered to print head elements of a thermal print head is increased so as to provide prints of acceptable quality despite the drop in voltage from the battery.

In accordance with an aspect of an embodiment, it is desirable to monitor whether the voltage available for printing is dropping rapidly, a condition that can occur as a battery approaches the end of its charge. Upon determination of rapid voltage drops, the printer can be shut off more rapidly under such conditions. For example, a signal value corresponding to the voltage of a power source at one time can be stored as a stored value. A signal value that corresponds to the then present voltage of the power source at a later time can be determined and stored as an updated or present signal value and compared with the stored signal value. Large or rapid changes in the voltage are revealed by this comparison. The stored signal value can be replaced with the updated signal value as a new stored signal value based on this comparison. The replacement can be done at a more rapid rate when large voltage decreases are detected between signal value determinations. If the updated signal value reaches a minimum low power threshold, the printer can be shut off. As a specific aspect of an embodiment, a fast drop counter can be incremented upon the occurrence of an instance of detection of a large drop in voltage. Updating of the stored signal can be delayed until, for example, a predetermined number of large voltage drop instances are detected. These large voltage drop instances can be called fast drop instances. The number of fast drop instances can be tracked in a counter, such as a fast drop counter, that can be reset under certain conditions. The predetermined number of large voltage drop instances can be set at a relatively low number so that updating of the stored signal occurs at a relatively rapid rate in response to recurring large voltage drop instances.

During actual printing of a print, and due to the power draw on a battery during such printing, the voltage from the battery naturally drops substantially during printing. The voltage then rises following such printing. In accordance with an embodiment, these voltage changes that occur during printing can be ignored. Thus, for example, a stored signal value corresponding to the voltage of the power source, such as the battery, can be maintained constant, and not updated in response to voltage changes determined during the time a printer is actually printing a print.

In accordance with yet another aspect of an embodiment, some printers are only powered by battery sources. Other printers can be powered by a battery source and alternatively by another power source, such as from an electrical power grid. For example, a battery charger can be plugged in to an electrical grid to recharge a battery with the grid also supplying power for use in printing while the battery is being recharged. In the event the printer is being powered by a non-battery power source, in accordance with one aspect of an embodiment, the stored signal can remain unadjusted or be updated less frequently. As a more specific aspect of one embodiment implementing this feature, an assumption can be made that, if a determined present value signal corresponding to the voltage of a power source is not less than an expected fraction of the maximum battery voltage if battery power is being used, the printer is being operated in other than a battery mode. If the printer is being operated in a battery mode, in one embodiment a battery mode counter can be incremented, such as each time battery mode is detected during successive periodic reading of signals corresponding to the present value of voltage from the voltage source. The number of battery mode counts can selectively be used to determine whether to change the stored signal value and the manner of changing such value. For example, if the determined present value signal corresponds to a voltage of the power source that is not less than the stored signal value, the battery mode count can be disregarded.

In accordance with another aspect of an embodiment, the present signal value can be taken as a sample and stored if the printer is not printing and the present value signal is less than the stored signal value. In this case, an increment sample counter can be incremented to indicate a sample has been obtained. If the present signal value sample is of a value that is less than a fail safe value corresponding to a fail safe level of voltage of the power source, a fail safe counter can be incremented. If the fail safe counter has a count that exceeds a threshold, that can be at a predetermined level, which can be greater than the predetermined fast drop maximum level, printing by the printer can be shut down or blocked.

As a further aspect of an embodiment, the present value signal can be compared with the stored signal to determine if the corresponding power source voltage has increased. In this case, an increment reset counter can be incremented. If the reset counter reaches a desired count, which can be predetermined, the stored signal value can be updated with the present value signal. In this manner, increasing voltages can be monitored and taken into account.

In accordance with yet another aspect of an embodiment, a battery polling or interrupt loop can be repetitively run to check for present value signals corresponding to the then existing voltage from a power source so as to monitor changes in such signals that correspond to changes in the voltage of the power source. System counters can be updated, such as explained above, based on such changes. In addition, a main loop can be run, such as when not interrupted by the interrupt loop. The main loop can monitor, for example, the occurrence of fast drop conditions, reset (increasing voltage) conditions, shutdown conditions and whether and how to update a stored signal value. In addition, the main loop can update displays, such as a battery indicator display, as well as cause adjustments to the energy delivered to a print head in response to changes in power available from a power source due to drops in voltage.

In accordance with a further aspect of an embodiment, plural sets of energy settings for a given combination of ink transfer ribbon and substrate can be stored, such as in the form of a lookup table or tables. The appropriate set of energy settings for the ink transfer ribbon/substrate combination for a given power availability from a power source can then be selected and used in printing to improve the quality of prints being printed. For example, if a stored signal value corresponding to battery voltage changes from corresponding to a value above a threshold battery voltage to a value corresponding to battery voltage at or below the threshold battery voltage, an energy setting that increases the energy delivered from the battery to the thermal print head can be selected and used. Conversely, if the stored signal value changes from a value corresponding to a voltage at or below the threshold to a value above the threshold, an energy setting that decreases the energy delivered from the battery to the print head can be used. The energy settings can change the energy delivered to the print head in any suitable manner, such as increasing the width of a voltage pulse being applied to heating elements of the printer or decreasing the resistance of a circuit in the path to the heating elements. Alternatively, instead of using lookup tables, other energy modification control approaches can be used, such as driving individual print head driving elements in response to control signals to control the energy provided from the battery to the print head.

As a further aspect of an embodiment, a method of operating a thermal print head of a printer to print a substrate can comprise: determining a signal value corresponding to the battery voltage of a battery operable to supply energy to the thermal print head and storing a signal value corresponding to the determined signal value as a stored signal value; and changing the energy delivered from the battery to the thermal print head in response to changes in the stored signal value, the act of changing the energy delivered comprises selectively increasing the energy delivered from the battery to the thermal print head in response to the stored signal value changing from a signal value corresponding to the battery voltage at a level above a threshold battery voltage to a signal value corresponding to the battery voltage at or below the threshold battery voltage.

As another aspect of a method, the act of changing the energy delivered can comprise selectively decreasing the energy delivered from the battery to the thermal print head in response to the stored signal value changing from a signal value corresponding to the battery voltage at or below the threshold battery voltage to a signal value corresponding to the battery voltage level above the at least one threshold battery voltage.

As a further aspect of an embodiment, there can be at least first and second threshold battery voltages. Also, the act of changing the energy delivered can comprise selectively increasing the energy delivered from the battery to the thermal print head in response to the stored signal value changing from a signal value corresponding to the battery voltage at a level above the first threshold battery voltage to a signal value corresponding to the battery voltage at or below the level of the first threshold battery voltage. In addition, the act of changing energy delivered can comprise selectively decreasing the energy delivered from the battery to the thermal print head in response to the stored signal value changing from a signal value corresponding to the battery voltage at or below the first threshold battery voltage to a signal value corresponding to the battery voltage above the first threshold battery voltage. Furthermore, the act of changing the energy delivered can comprise selectively increasing the energy delivered from the battery to the thermal print head in response to the stored signal value changing from a signal value corresponding to the battery voltage at or below the first threshold battery voltage to a signal value corresponding to the battery voltage at or below a second threshold battery voltage. Also, the act of changing the energy delivered can comprise selectively decreasing the energy delivered from the battery to the thermal print head in response to the stored signal value changing from a signal value corresponding to the battery voltage at or below the second threshold battery voltage to a signal value corresponding to the battery voltage above the second threshold battery voltage.

As yet another aspect of an embodiment, a method can comprise turning off the delivery of energy to the thermal print head in response to the stored signal value changing from a signal value corresponding to the battery voltage at a level that is above a power off threshold battery voltage to a signal value corresponding to the battery voltage at or below the power off threshold battery voltage.

As a further aspect of an embodiment, the act of selectively changing the energy delivered can comprise not changing the energy delivered in the event the signal value corresponding to the present voltage of a printer power source is determined during a time the thermal print head is printing a print. Also, the act of selectively changing the energy delivered can comprise not changing the energy delivered when the printer is powered by a source other than the battery.

As a further aspect of an embodiment, a method can comprise the act of increasing the rate of change of the stored signal value in response to decreases in the determined signal value that occur at a rate that is greater than a fast drop rate.

An accordance with another aspect of an embodiment, a method of operating a thermal print head of a printer to print a substrate can comprise: determining a determined digital signal value that corresponds to the voltage of a power source coupled to the thermal print head, the power source being operable to supply energy to the thermal print head; storing at least one stored digital signal value corresponding to the voltage of the power source at a time prior to the time of determining the determined digital signal value; comparing the determined digital signal value to the stored digital signal value; selectively changing the value of the stored digital signal value in response to the comparison; and selectively increasing the energy delivered from the power source to the thermal print head in response to the comparison if the stored digital signal value corresponds to a voltage of the power source that is at or below a first threshold value of voltage.

In accordance with an embodiment, the act of selectively increasing the energy delivered can comprise determining if the power source is a battery and not increasing the energy delivered from the power source to the thermal print head if the power source is not a battery. In addition, the act of selectively changing the value of the stored digital signal value can comprise not changing the stored digital signal value if the determined digital signal value is determined during a time in which the thermal print head is printing a print.

In accordance with another aspect of an embodiment, the act of selectively changing the value of the stored digital signal can also comprise decreasing the value of the stored digital signal at a first rate of decrease if the determined digital signal value has decreased at a one rate relative to the stored digital signal value, and decreasing the value of the stored digital signal at a second rate of decrease if the determined digital signal value is decreasing at another rate that is greater than the one rate, the second rate being greater than the first rate. In addition, the act of selectively changing the value of the stored digital signal can comprise increasing the value of the stored digital signal if the determined digital signal value is increasing at a rate of increase that is at least equal to a first rate of increase rate.

In accordance with an aspect of an embodiment, the supply of energy to a thermal print head can be interrupted or printing by the print head can be interrupted if the determined digital signal value is less than a value corresponding to a minimum voltage level.

In accordance with another aspect of an embodiment, the act of determining a digital signal value can comprise obtaining a digital signal value from an analog to digital converter that receives an input corresponding to the voltage of a power source coupled to a thermal print head, periodically sampling the determined digital signal value to provide a digital sample value and adding a digital calibration signal value to the digital sample value to determine the determined digital signal value that corresponds to the voltage of the power source coupled to the thermal print head.

In accordance with another aspect of an embodiment, a method of operating a thermal print head to print a substrate can comprise:

repetitively performing acts comprising A through F below:

A. obtaining a digital signal sample value for a sampling time, the digital signal sample value corresponding to the voltage of a power source coupled to the thermal print head;

B. comparing the digital signal sample value obtained for one sampling time with a stored digital signal sample value for prior sampling time prior to the said one sampling time, and incrementing a fast drop count if the digital signal sample value for said one sampling time is less than the stored digital signal sample value by a fast drop value;

C. incrementing a sample count if the digital signal sample value for the one sampling time is not obtained during a time that the thermal print head is printing a print and the digital signal sample value for the one sampling time is less than the stored digital signal sample value;

D. incrementing a battery mode count if the digital signal sample value for the one sampling time is less than a first predetermined battery mode operation indicating value;

E. incrementing a reset count if the digital signal sample value for the one sampling time has increased by more than a predetermined amount over the stored digital signal value;

F. incrementing a fail safe count if the digital signal sample value for the one sampling time corresponds to a voltage of the power source that is less than a fail safe value; and repetitively performing the acts comprising G through L below:

G. determining a digital signal value that corresponds to the voltage of the power source coupled to the thermal print head;

H. turning off power to the thermal print head if (i) a power-off value is greater than or equal to the stored digital signal sample value; or (ii) the fail safe count from act F is greater than or equal to a maximum fail safe count; and (iii) returning to act G;

I. if the reset count from act E is greater than a maximum reset count, then: (i) replacing the stored digital signal sample value with the digital sample value for said one sample time; (ii) and resetting the fail safe count, the reset count, the battery mode count, the sample count and the fast drop count to respective initial values; and returning to act G;

J. if the fast drop count from act B is greater than a maximum fast drop count; then: (i) replacing the stored digital signal sample value with the digital sample value for said one sample time; and (ii) returning to act G;

K. if the fast drop count from act B is not greater than the maximum fast drop count and the digital signal sample value for said one sampling time is not less than the stored digital signal sample value, then: return to act G;

L. if the fast drop count is not greater than the maximum fast drop count and the digital sample value obtained for said one sampling time is less than the stored digital signal sample, then: (i) if the battery mode count from act D is greater than a maximum battery mode count, resetting the fail safe count, the reset count, the battery mode count, the sample count and fast drop count to respective initial values and replacing the stored digital signal sample with the highest determined digital signal value that is determined since the previous resetting of the battery mode count that is less than the stored digital signal sample value and return to act G; or (ii) if the battery mode count from act D is greater than or equal to an update indicating value battery mode count that is less than the maximum battery mode count and the sample count from act C is greater than or equal to a maximum sample count, replacing the stored digital signal sample value with the digital signal sample value for said one sampling time and resetting the fail safe count, the reset count, the battery mode count, the sample count and the fast drop count to their respective initial values and return to act G.

In accordance with another embodiment, a thermal printer for transferring ink from an ink transfer ribbon to a substrate, energy from a battery or other power source being provided to a print head of the printer to selectively heat elements of the print head to transfer ink from the ink transfer ribbon to the substrate to print the substrate. The printer can comprise: a computer processor comprising an input for receiving a present value signal corresponding to the voltage of the power source; the computer processor comprising memory that stores a signal value corresponding to the received present value signal, the memory storing at least one stored signal value corresponding to the voltage of the power source at a time prior to the receipt of the present value signal; the computer processor comparing the present value signal to said at least one stored signal value and selectively changing the stored signal value to a stored updated signal value based upon the comparison; and the computer processor controlling the energy delivered to the print head from the power source based upon the comparison to selectively increase the energy delivered to the print head if the stored updated signal value changes from corresponding to a battery power source voltage above a first threshold to correspond to a battery power source voltage that is at or below the first threshold.

As a further aspect of an embodiment, the thermal printer can have or comprise a non-battery mode of operation in which energy is provided to the print head from a power source other than a battery, wherein if the present value signal corresponds to a voltage that is not less than a battery mode threshold voltage, the computer processor controls the energy delivered to the print head so as to not selectively increase the energy delivered to the print head.

As another aspect of an embodiment, the thermal printer can comprise a computer processor that receives an input signal indicating the printer is printing a print, the computer processor controlling the energy delivered to the print head so as to not increase the energy delivered to the print head in response to changes in the present value signal due to printing of a print.

As a further aspect of an embodiment, the thermal printer can comprise a computer processor that changes the stored signal value to a stored updated signal value by decreasing the stored signal value at a first rate of decrease if the present value signal has decreased at a one rate relative to the stored signal value, and by decreasing the stored signal value at a second rate of decrease if the present value signal is decreasing at another rate that is greater than the one rate, the second rate being greater than the first rate.

As yet another aspect of an embodiment, the thermal printer can comprise a computer processor that changes the stored signal value to a stored updated signal value by increasing the stored signal value if the present value signal is increasing at a rate of increase that is at least equal to a first rate of increase rate. Also, the computer processor can be programmed so as to interrupt of the supply of energy to the thermal print head if the present value signal corresponds to a voltage that is less than or equal to a minimum voltage threshold.

As yet another aspect of an embodiment, a thermal printer can comprise an analog to digital converter that receives an input corresponding to the voltage of the power source coupled to a thermal print head, the computer processor periodically reading the analog to digital converter value to provide digital sample values and adding a digital calibration signal value to the digital sample values to provide present value signals that correspond to the voltage of the power source coupled to the thermal print head.

These and other novel and non-obvious features and method acts will become more apparent from the description below and the drawings. The present invention encompasses all such novel and non-obvious method acts and features individually, as well as in combinations and sub-combinations with one another.

DETAILED DESCRIPTION

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

Figure 1:
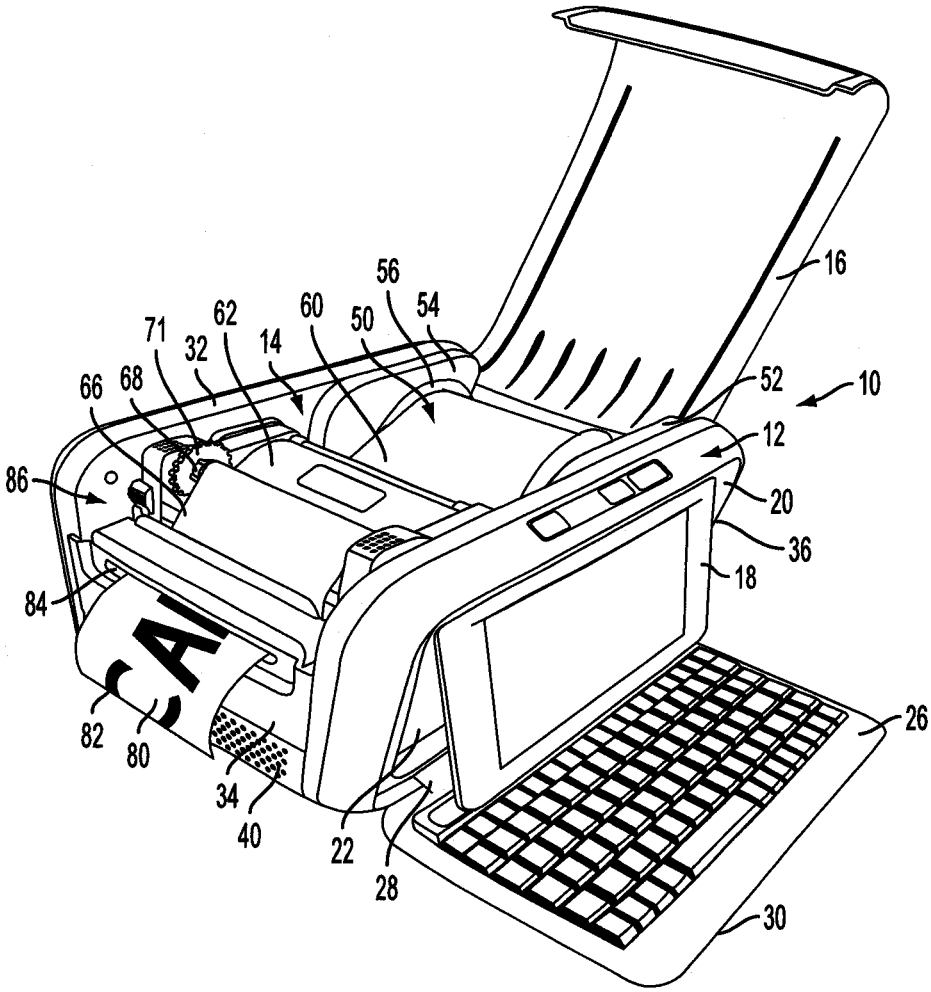
FIG. 1 is a perspective view of one embodiment of a thermal printer that is open to show selected components of the printer. The FIG. 1 embodiment illustrates a thermal printer with numerous ornamental features that can be modified without interfering with the functionality of the printer.
Figure 2:
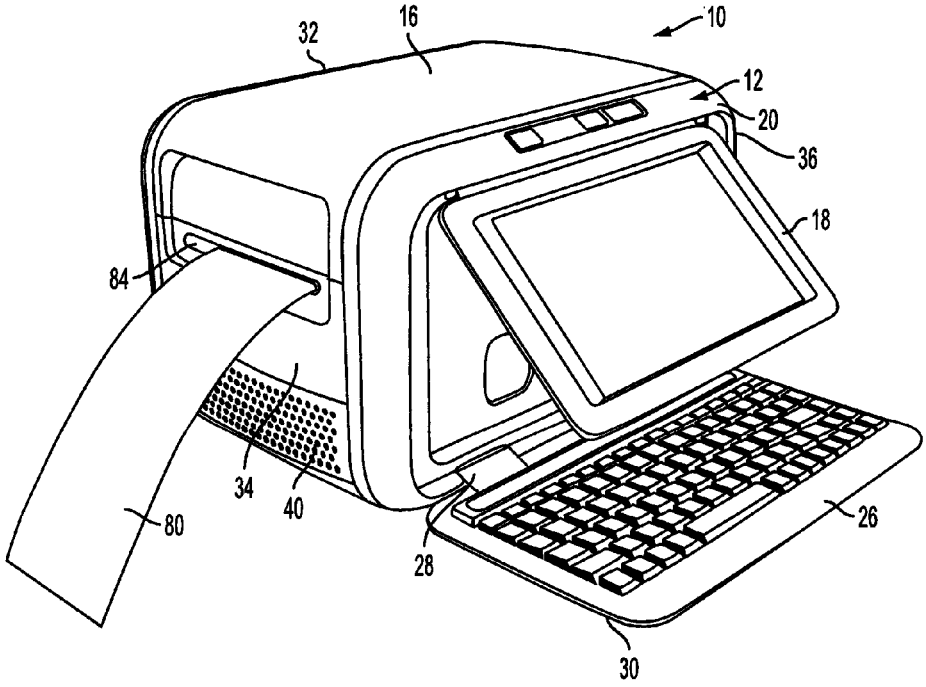
FIG. 2 is a perspective view of a thermal printer in accordance with FIG. 1 that is closed.
Figure 3:
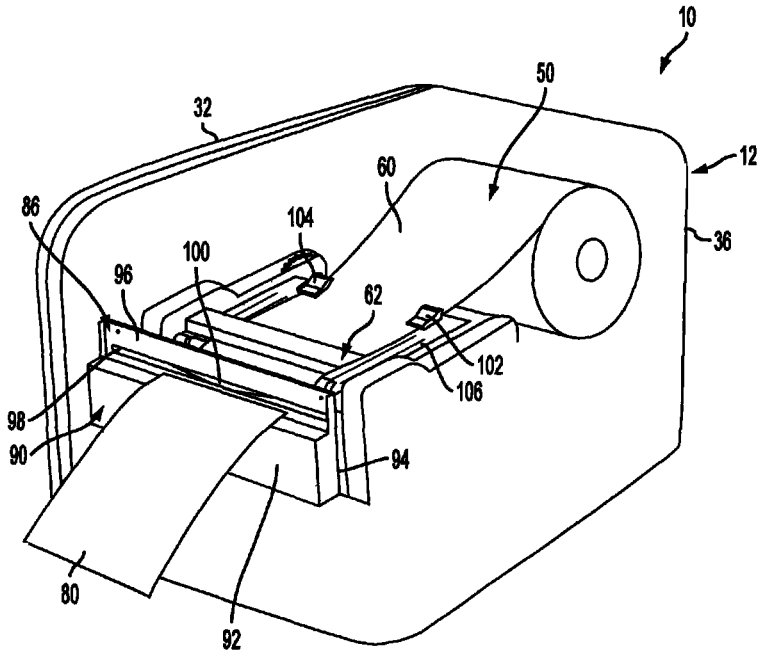
FIG. 3 is a partially broken away view of the printer of FIG. 1 with some components removed for convenience.

With reference to FIGS. 1-3, an exemplary thermal printer 10 comprises a housing 12 having an upwardly opening internal chamber 14 that is selectively closable by a cover 16 that can be pivoted to the housing. A display, such as a screen 18 is included in the illustrated printer. The display is shown positioned along a side wall 20 of the printer housing 12. Side wall 20 can include a recess 22 sized to receive the display when the display is moved from a deployed position as shown in FIG. 1, wherein the display is angled outwardly from side wall 20 from an upper portion of the recess 22, to a stowed position, wherein the display is positioned within the recess 22. The display 18 can be hinged or otherwise pivoted to the housing such as along its upper edge.

A data input device, which can take any suitable form, such as a keyboard, touch screen, or other data input is shown in FIG. 1. In FIG. 1, the data input device comprises a keyboard 26 that can be used, for example, to enter lettering or other messages to be printed by the printer onto print substrate as explained below. The keyboard 26 can be pivoted to the housing, such as by first and second hinges, one being indicated by the number 28 in FIG. 1, for pivoting about a pivot axis from a deployed position, such as shown in FIG. 1, to a stowed position wherein the keyboard is positioned against side wall 20 to thereby protect the keyboard and screen 18. In this example, the hinge 28 and a companion hinge allow pivoting of keyboard 26 about a longitudinally extending axis adjacent to a lower bottom edge of side wall 20. The axis about which keyboard 26 pivots can be parallel to and spaced from the axis about which screen 18 pivots. The bottom surface 30 of keyboard 26 can comprise a durable material, such as a relatively hard polymer or plastic to provide protection to the internal components when the display 18 and keyboard 26 are stowed.

The housing 12 also can comprise a durable material such as polymer or plastic. In addition to side wall 20, the illustrated housing 12 comprises an opposed side wall 32 spaced transversely from side wall 20 and first and second end walls 34, 36. Although not shown in FIG. 1, side wall 32 can comprise a recess for receiving a rechargeable battery that is the sole power source for the printer at least when the printer is not at a location where it can be plugged into a battery charger or other power source. In one desirable embodiment, the battery is the sole power source for the printer and must be removed for recharging. End wall 34 is provided with ventilation apertures 40 communicating with the interior of chamber 14 through which heat from the printer can dissipate.

In the thermal printer of FIGS. 1-3, substrate to be printed is moved through the printer along a print flow path. The thermal printable substrate can take any number of forms. For example, the substrate can comprise thermoplastic polymer films, sheets or fabrics. In one specific example, the substrate can comprise a multi-layered material, such as a plurality of thermoplastic layers of high density polyethylene (HDPE) that has been extruded, stretched, bias-cut and cross laminated into a composite structure that can comprise, for example, between thirteen and fifteen layers. Vinyl is another example of a suitable substrate. This disclosure is not dependent upon the type of substrate that is used.

A thermal ink transfer ribbon is sandwiched with the substrate and moved relative to a thermal print head along the print flow path into contact with the print head. Thermal ink transfer ribbons are of varying constructions. In one specific example, the ink transfer ribbon comprises an ink carrier or backing ribbon of polyester with an ink coating on a first side of the backing ribbon that faces the printing substrate and is on the opposite side of the backing ribbon from a thermal print head. The second side of the ribbon, opposite to the first side and facing the thermal print head conventionally can be coated with a friction and static reducing back coat material to facilitate sliding of the ribbon across the surface of the thermal print head during printing. The ink coating will release from the carrier when heated to heat transfer the ink to the printing substrate. The operation of the thermal print head is controlled in a conventional manner to selectively heat the print head (e.g. individual pixels of the print head being heated as required to transfer portions of the ink from the ink transfer ribbon) to cause the transfer of ink from the ink transfer ribbon to the adjacent surface of the print substrate in the desired pattern to be printed thereon. The ink transfer ribbon is then separated from the substrate with the printed substrate exiting the printer. In the case of a continuous roll form substrate, a cutter can be included in the print flow path for cutting or separating pieces of the substrate, such as labels, following printing.

With reference to FIGS. 1 and 3, and keeping in mind that the disclosure is not limited to the use of roll form substrates or roll form ink transfer ribbons, a roll of substrate 50 is shown positioned within the housing 12. The substrate roll can be supported by a rod or axle coupled to the respective side walls 20, 32 of the housing, such as to interior wall portions 52, 54 that project inwardly from the respective side walls 20, 32. The substrate roll 50 is supported for pivoting about a transverse axis such as about an axis that is perpendicular to the longitudinal axis of the printer and to the direction of travel of the substrate. The substrate roll 50 can be supported by a reel 56, or a core not shown, on a pin or rod extending between wall portions 52, 54 (or between spool or core holders projecting outwardly from the opposed wall portions) so as to allow the roll to rotate about the support axis to unroll substrate from the substrate roll during printing. The supporting axle, rod or core can be rotatably coupled to side wall portions 52, 54 or the core or spool 56 can be rotatable about a fixed rod.

FIG. 1 shows a portion 60 of substrate being fed from roll 50 to the underside of a thermal print head 62 coupled to the housing 12. A roll of ink transfer ribbon, that can be rotatably supported in the same manner as substrate roll 50, is positioned within chamber 14 of housing 12 for supplying the ink transfer ribbon to be used in the printing operation (this ink ribbon supply roll is not shown in FIG. 1 for convenience, but is shown as ink transfer ribbon roll 61 in FIG. 5). The roll of ink transfer ribbon can be supported for rotation about a transverse axis parallel to the axis of rotation of substrate roll 50 for rotation about a transverse axis extending between wall portions 52 and 54. The ink transfer ribbon is positioned in contact with one major surface of the substrate and a sandwich of ink transfer ribbon and substrate is moved in contact with the thermal print head with the print head heating the ink transfer ribbon to transfer the desired print pattern to the major surface of the substrate. The substrate as shown in FIG. 1 has an upper major surface and a lower major surface, as well as side edges. The upper major surface is visible in FIG. 1.

In FIG. 1, ink transfer ribbon 66 is separated from the substrate at a location downstream from the location where printing occurs (where the ink transfer ribbon is heated). The used ink transfer ribbon is wound onto a rod 68 of an ink transfer ribbon take up mechanism. The ink transfer ribbon take-up rod, axle or core can be driven, such as via an electric motor and a drive gear 70 to take up the slack in the ink transfer ribbon as the ribbon exits from contact with the thermal print head. The printed substrate 80, with printing 82 thereon, exits from the printer via a slot 84 in the end wall 34. In the case of continuous roll form substrates, a cutter, indicated generally at 86 can be included and operated to cut the substrate at a desired location to sever the printed substrate from the remainder of the substrate roll. For example, in the case of a label printer, the substrate can be severed following the printing of each label. Alternatively, the labels can be manually separated following printing.

FIG. 3 illustrates one form of a suitable cutter in greater detail. The illustrated form of cutter 86 comprises a housing 90 having a front wall 92 and a rear wall 94. A portion 96 of the rear wall projects upwardly from the main body of the housing 92. A slot 98 extends through rear wall 96. The slot is positioned in the print flow path downstream from the thermal print head such that the substrate is guided through the slot toward the exit slot 84 from the printer housing. A blade 100 is reciprocated to cut the substrate and sever the printed substrate 80 from the roll 50.

Figure 5:
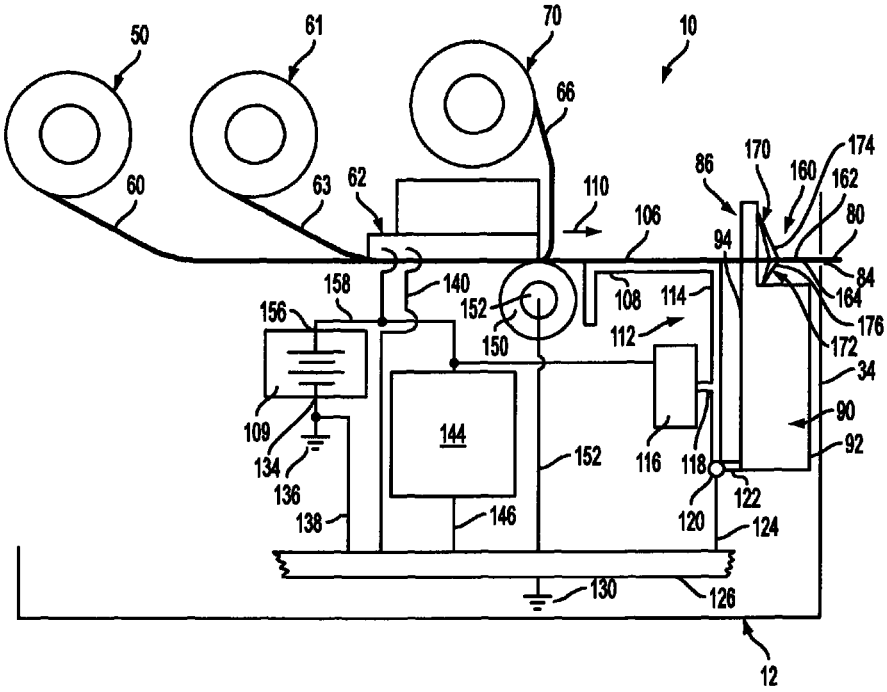
FIG. 5 is a side elevational view of an embodiment of a thermal printer that schematically illustrates a number of components of the printer.

In FIG. 3, the substrate material 60 leaving the substrate roll 50 is guided by spaced apart guides 102, 104 that engage the upper major surface and side edges of the substrate. The side to side spacing of the guides 102, 104 can be varied to accommodate substrates of different widths. The lower major surface of the substrate is supported by support surface 106, such as a planar upper surface of a support 108 (see FIG. 5). As shown in FIG. 5, the support portion 108 can be a support plate portion with surface 106 positioned in the print flow path to provide support for the lower major surface of the substrate as it moves in the print flow path, such as in the downstream direction indicated by arrow 110 in FIG. 5. The support portion 108 can comprise an extension portion of a support bracket 112 and more specifically a projecting portion extending from the upper end of an upwardly extending portion 114 of the bracket 112. The bracket 112 is coupled to the housing 12. A cutter control circuit board 116 that provides control signals to the cutter to cause cutting of the substrate can also be supported by the support bracket 112, such as by a circuit board supporting extension portion 118 extending from the bracket portion 114 of the bracket 112. A pivot, such as a hinge 120 can be provided at a lower portion of the support portion 114. The housing 90 of the cutter 86 can be coupled by pivot 120 for pivoting about a transverse axis through the pivot 120, the transverse axis desirably being perpendicular to the direction 110 of substrate travel. The bracket 112 desirably comprises a cutter support portion 122, that extends from pivot 120 and supports the cutter housing 90. With this construction, the cutter housing can be pivoted (together with the support bracket 112) to provide access to the interior of the printer.

The bracket 112, pivot 120 and pivot extension 122, as well as the cutter housing 90, can all be of or comprise an electrically conductive material. The bracket can be electrically coupled, such as indicated schematically by a conductor 124 to an electrically conductive portion 126 of a chassis frame of the printer and an internal ground 130 of the printer. A battery 109 that can provide power to the printer has an anode 134 corresponding to a battery ground 136 which is shown schematically coupled to the chassis or frame portion 126 such that the battery ground 136 corresponds to the internal ground 130 of the printer. The electrical connection of the battery ground 136 to the internal ground 130 is indicated schematically by the conductor 138 in FIG. 5. The thermal print head 62 can also be electrically coupled, such as indicated schematically by conductor 140, to the internal ground. In addition, a main circuit board 144, can also be electrically coupled, such as by a schematically indicated conductor 146 to the internal ground. The main circuit board in this embodiment provides control signals to cutter circuit board 116, controls the operation of the thermal print head 62, and receives inputs from the input device such as keyboard 26 (FIG. 1).

Although various mechanisms can be used for advancing a sandwich of substrate and ink transfer ribbon through the printer along the print flow path, in FIG. 5 a platen roller 150 is shown for this purpose. Roller 150 is driven by rotating the roller to move the substrate and ink transfer ribbon through the printer, such as in the direction of arrow 110. The platen can also be operated to reverse the direction of rotation of the platen if desired. The roller 150 can comprise a roller with a polymer exterior surface and can comprise rubber. The illustrated roller backs up the lower major surface of the substrate at or adjacent to the location where printing takes place. The platen can be drivenly supported by an axle or rod 152 that can comprise an electrically conductive material coupled to the internal ground. This coupling is represented schematically by a conductor 152 shown connecting the axle 152 to the frame portion 126 and thus to the internal ground 130. The cathode 156 of the battery 132 is shown schematically coupled to the thermal print head 62, the main circuit board 144 and to the cutter circuit board 116 by conductors collectively indicated by the number 158. Other powered components of the printer, such as a driver for platen 152 and the take up 170 also can be electrically coupled to the battery by electrical conductors that are not shown. FIG. 5 also illustrates a roll of ink transfer ribbon 61 on an ink transfer ribbon support 63.

During printing by a thermal printer, particularly one powered solely by a battery, static electricity can build up on the surfaces of the substrate, such as on the upper and lower major surfaces of the substrate in FIG. 5. Certain types of substrates are more prone to higher levels of static build up. The static electricity build up is particularly pronounced when certain types of substrates, such as vinyl, move through the print head and are printed thereon. In the case of a rolled substrate, the source of static electricity is not entirely clear. However, the static electricity may arise from unrolling of the substrate, from unrolling an ink transfer ribbon that is placed in contact with the substrate to form a sandwich of the ink transfer ribbon and substrate as it passes the thermal print head, from printing by the thermal print head and/or from the separation of the ink transfer ribbon from the sandwich following printing and prior to discharge of the printed substrate from the printer. Regardless of the source of the static electricity, it is possible for a charge in excess of 20 kilovolts to develop in the printer operated to continuously permit a roll of thirty feet of vinyl substrate. A static buildup of this magnitude, or a somewhat lower magnitude, if discharged in an uncontrolled manner, can damage printer circuitry. It is desirable that the static electricity be completely discharged from the printed substrate, although a discharge to a potential below about 8 kilovolts minimizes or eliminates the risk of damage to the printer from the static electricity. To reduce this build up to a level that is sufficiently low so as to prevent this damage, for example to a range of between positive or negative 8 kilovolts, an electrical static discharge mechanism can optionally be included in embodiments of a thermal printer disclosed herein.

Figure 4:
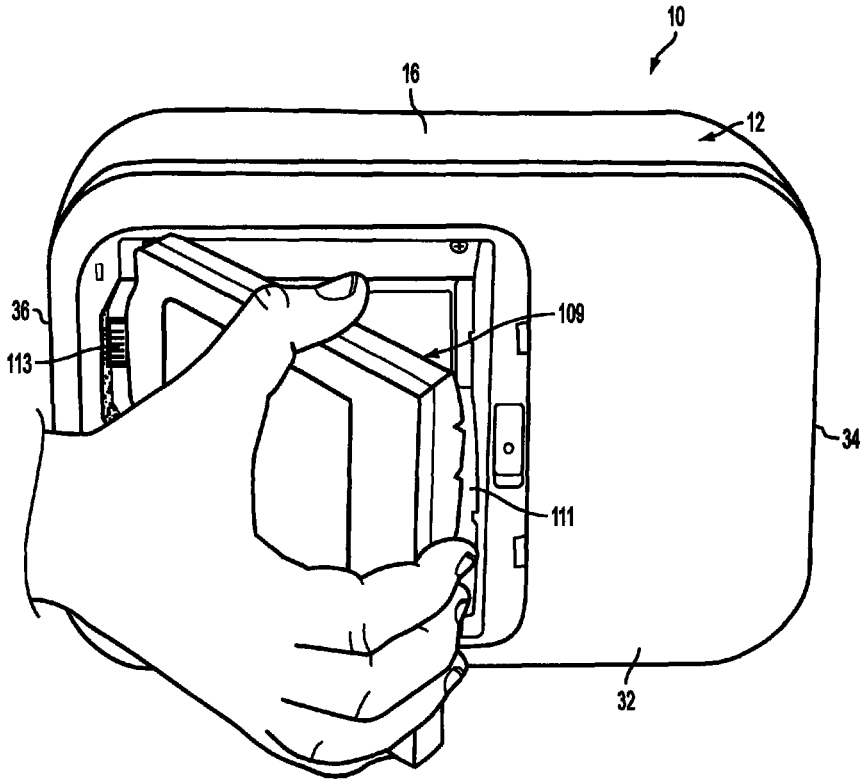
FIG. 4 is a perspective view of an exemplary thermal printer illustrating the insertion of a battery for powering the printer, into a battery receiving compartment of the printer housing.

FIG. 4 illustrates an exemplary printer looking toward side wall 32 thereof. Side wall 32 is provided with a recess or pocket 111 sized to receive a battery 109 inserted therein with terminals of the battery (anode and cathode terminals) connected to electrical contacts of circuitry within the printer, with one such contact being indicated at 113 in FIG. 4. The battery can be inserted and removed from the pocket 111 for recharging or replacement as needed. The battery 109 can comprise any suitable portable power source, such as a lithium or metal hydride battery, or a fuel cell electrical power supply.

When the printer is being operated in a stand alone mode of operation powered solely by power from a battery 109, the internal electrical ground 130 can be the only electrical ground for the printer as the printer is not connected to a power grid and thus is not connected to the external electrical ground of the power grid. If the battery is being charged by a battery charger from the electrical grid, such as from an A/C to D/C converter coupled to the grid, the internal electrical ground can be connected to the grid ground with power for the printer being available from the battery. In this case, as an alternative, the power can be supplied from the A/C to D/C converter output or from the battery output, whichever is at the highest potential. As another alternative, the printer can be powered solely by the battery, with the battery being required to be removed from the printer for recharging. In this latter example, the only effective electrical ground for the printer is the internal electrical ground. Some printer embodiments can be powered by a connection to the electricity grid, such as to an alternating current power source and electrically grounded via a ground of the power supply, which reduces static electricity buildup without the use of one or more static electricity dischargers, although it/they can be included.

Figure 4A:
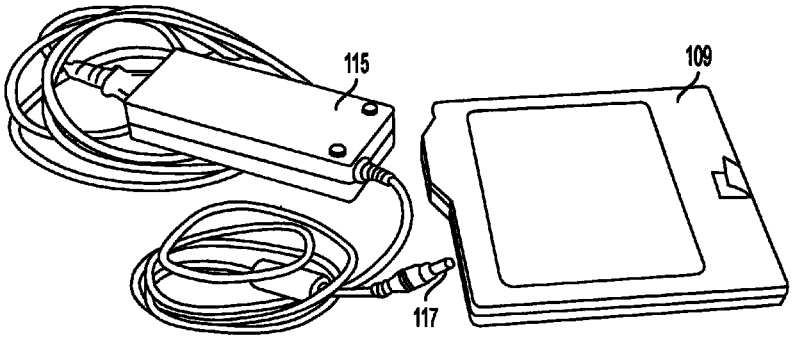
FIG. 4A is a perspective view of a battery that can be used in the printer of FIG. 1 for providing electrical power to the printer, together with a charger that can be used to charge the battery.

FIG. 4A illustrates the battery 109 removed from the printer housing 12. A battery charger 115 having a charging connecting 117 for coupling to a charging input port of battery 109 is shown. The battery charger can be plugged into a standard A/C outlet to provide charging power to the battery. Alternatively, a vehicle charger can be used. The battery can be configured with a charging input that allows charging of the battery without removal of the battery from the thermal printer.

With further reference to FIG. 5, a static discharge mechanism 160 can be provided to discharge (which includes neutralizing) static charge on the major surfaces 162, 164 of the substrate between the side edges thereof that would otherwise develop during printing. During such printing, typically a positive static electricity charge would otherwise build up on these surfaces.

Such a static discharge mechanism can comprise at least one static electricity discharger positioned to engage at least one of the first and second major surfaces 162, 164 to sweep or discharge static electricity from the engaged major surface or surfaces. It has been found that discharging of some static electricity charge occurs if only one of the major surfaces is engaged by a static electricity discharger. However, a more complete discharge of static electricity takes place if a first static electric discharger engages one of the major surfaces and a second electric static discharger engages the other of the major surfaces.

The other aspects of this disclosure can be alternatively included in embodiments without a static discharge mechanism.

Figure 6:
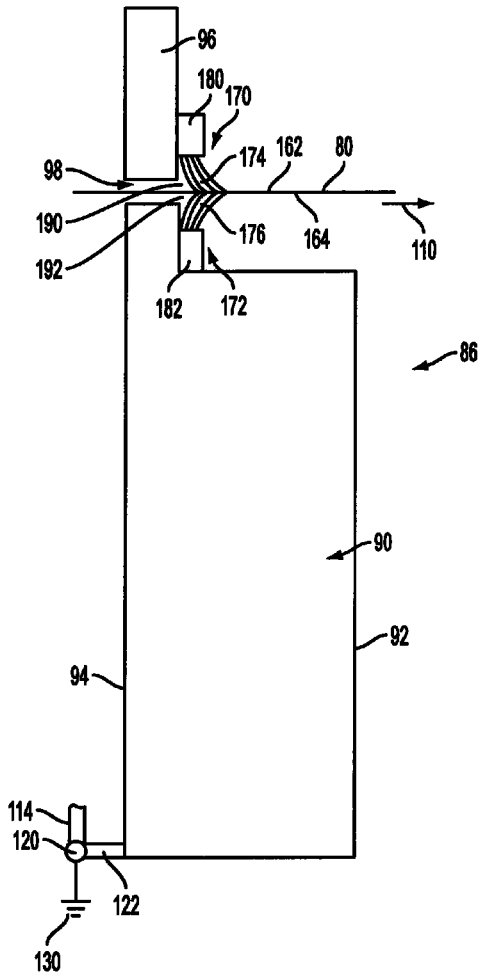
FIG. 6 is a schematic side elevational view of a cutter that can be included in a printer for separating the substrate into pieces, such as separating a printed label from remaining portions of the substrate.

The static electric dischargers, if included, can each comprise an electrically conductive static electricity discharge element that contacts a respective major surface of the substrate and that is electrically coupled to the internal ground. In one specific example, the discharge elements can comprise one or more brushes, such as two brushes 170, 172 shown in FIG. 5. The brush or brushes 170 can comprise a plurality of electrically conductive bristles 174 that contact the upper major surface 162 of the substrate 80. In addition, the one or more brushes 172 can comprise a plurality of bristles 176 in contact with the lower major surface 164 of the substrate 80. The static electric discharge members can desirably be positioned downstream from the print location where ink is transferred from the ribbon to the substrate. In FIG. 5, the brush type electric discharge members 170, 172 are positioned such that the bristles engage the respective major surfaces 162, 164 of the substrate at a location downstream from the cutter 86 that cuts the substrate from the roll. Alternatively, the brush type electric discharge elements can be mounted to the opposite side of the cutter to position the bristles at a location upstream from the cutter. In addition, as another alternative, the brushes can be supported at locations spaced from the cutter, either upstream (between the print location and the cutter) or downstream from the cutter. As can be seen in FIG. 6, these static electricity discharge elements can comprise a base, for example base 180 for discharger 170 and base 182 for discharger 172. Base 180 supports bristles 174 so as to project outwardly from the base and toward the associated major surface 162 with tip portions of the bristles 174 contacting the surface 162. Similarly, bristles 176 are supported by base 182 so as to project outwardly from the base toward the major surface 164 of the substrate with tip portions of the bristles 176 contacting the major surface 164. As the substrate 80 travels in the direction 110, the bristles of the embodiment shown in FIG. 6 have sufficient flexibility so as to bend as shown with the tips of the bristles engaged by the substrate surfaces moving in a downstream direction. In this example, an acute angle 190 exists between tip portions of the bristles 174 and the upper surface 162 and a similar acute angle 192 exists between the tip portions of bristles 176 and the contacted surface 164.

The bristles 174, 176, if included, are desirably comprised of electrically conductive materials. In addition, in this example, the respective bases 180, 182 can also be comprised of electrically conductive materials. In this example, with a cutter housing 90 comprising electrically conductive materials, an electrically conductive flow path is provided from the surfaces of the substrate via the respective bristles and bases and the cutter housing and the support 122 to the internal ground 130. As a result, the static electric charge is in effect coupled to ground and discharged or neutralized from the surfaces 162, 164 of the substrate to a sufficient level (e.g., less than 8 kilovolts) so as not to risk damage to printer electronic components. The electric discharge members, such as bristles 174, 176 can be coupled to the internal ground other than through the cutter housing.

Desirably, the electrical resistance between the tips of the bristles and the internal ground is less than about 200 ohms. Although other materials can be used for the bristles 174, 176, one specific exemplary material comprises carbon fiber brush hairs having a diameter of approximately 0.01 mm and a length of approximately 8.26 mm. These hairs can be provided at a density of, for example, about 10,000 hairs per linear inch of base. Alternatively, the bristles can be provided in the form of tufts or bunches of bristles mounted to the base at spaced locations along the base with, for example, a spacing of approximately 5 mm per tuft and 1500 bristles per tuft. The length of the bases and brushes can be varied. For example, a length of about 4.25 inches can be used for printing labels of a width (in a direction transverse to the direction of 110) that is about 4.25 inches, although static electric discharge will also take place if a substrate has a width that is narrower or wider than the width of the brushes. It is however desirable that, if included, the brushes be at least within 80 percent of the overall width of the substrate. The brushes are desirably positioned and supported such that the bristles lightly contact the upper and lower surfaces of the substrate.

It should be noted that the bristles can be of other materials, such as copper, although copper bristles have been found to be less effective than carbon bristles. In addition, stainless steel bristles, although suitable to discharge some static electricity, can mar the surface of the substrate because of the hardness of the stainless steel. As another alternative, the electrically conductive elements can be electrically conductive fabric, such as comprised of woven carbon or other electrically conductive materials, such as in sheet form. Static electricity dischargers comprising bristles as the discharge elements are particularly desirable.

Desirably, the static electricity dischargers, if included, do not require electric power to operate to discharge static electricity. Thus, these passive static electricity dischargers do not suffer from the drawback of requiring electrical power to operate which would shorten the length of time the printer can be used between battery recharges.

Figure 7:
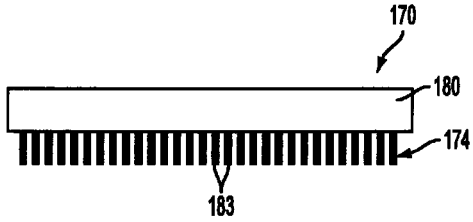
FIG. 7 is a front elevational view of one form of a static electricity discharge member that can be included to discharge static electricity from the substrate.

FIG. 7 illustrates one exemplary form of a brush type electrical discharge member 170 having an elongated base 180 and a plurality of bristles 174. The bristles 174 are shown in the embodiment of FIG. 7 in the form of tufts of plural bristles, some of these tufts being indicated by the number 183 in this figure.

Figure 8:
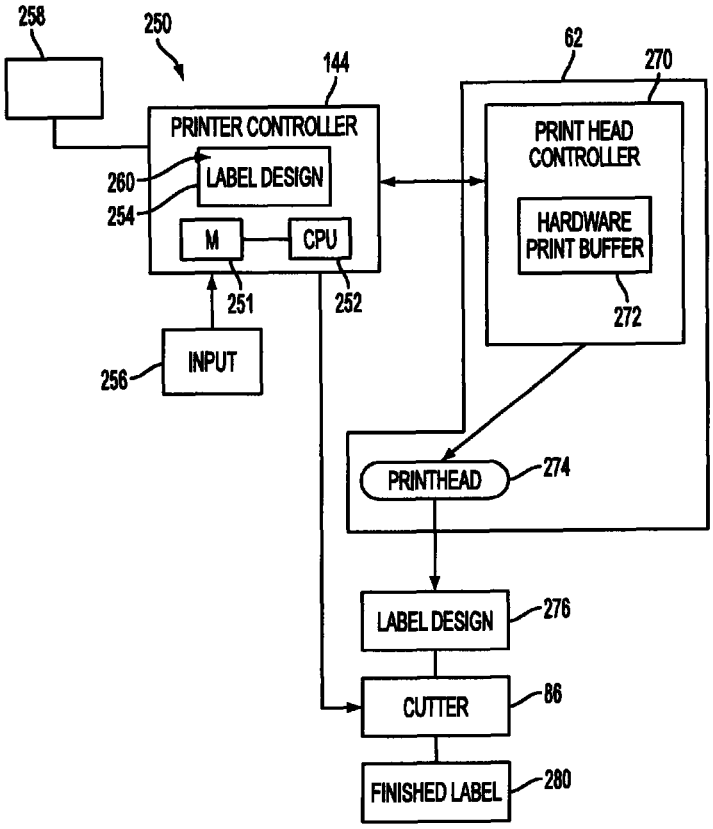
FIG. 8 schematically illustrates a printer embodiment usable for printing print data for printing on a label or other substrate piece.

With reference to FIG. 8, one exemplary control circuit for a thermal printer in accordance with this disclosure is schematically shown. It is to be understood that the illustrated printer control is only one example thereof. In FIG. 8, a printer controller 250 is shown and can be mounted on the printed circuit board 144. The illustrated printer controller comprises a microprocessor or central processing unit 252 and associated memory 251, 254 that can comprise any suitable form of memory. An input device 256 is shown coupled to the printer controller. The input device can comprise a keyboard, touchscreen, mouse, pen, trackball, voice input device, scanning device, disk reader and/or any other suitable device for delivering input such as print data and other instructions to the print controller. The printer can also comprise a display, or output, such as a display screen indicated at 258, that can be viewed by a user of the input device to monitor the progress of an input and/or to design a label or message. As one specific example, input device 256 can be used to design a message to be printed, such as indicated by the label design 260 schematically shown stored in memory 254 The print data for printing the depicted label would typically be stored in digital form. Desirably, the printer controller and other components are self-contained as part of a portable printer unit. However, discrete components can be utilized. In addition, wireless connections as well as hardwired connections can be used between components. Also, computing functions can be accomplished in the cloud using wireless communication protocols. Print data corresponding to the label design or message to be printed by the printer is delivered in this example from the printer controller to memory of a print head controller 270, such as to a hardware print buffer 272 of the print head controller. This print data is then used by the print head controller to control the operation of a thermal print head 274 to cause heating of desired pixel heating elements in the print head as the substrate and ink transfer ribbon pass the print head in the downstream direction. This results in printing of the label design on a label, as indicated at 276. In an example where a substrate is supplied from a continuous roll of substrate, as opposed to discrete pieces of substrate which can alternatively be used, following printing of the print data, the printer controller controls the operation of the cutter 86 to sever the printed label or other message from the roll to produce the finished label 280.

The computing system shown in FIG. 8 for the printer is not intended to suggest any limitation as to scope of use or functionality, as the innovations can be implemented in diverse general-purpose or special-purpose computing systems. Thus, one or more processing units and memory can be used. The processing units execute computer-executable instructions. A processing unit can be a general-purpose central processing unit (CPU), processor in an application-specific integrated circuit (ASIC) or any other type of processor. In a multi-processing system, multiple processing units can execute computer-executable instructions to increase processing power. For example, FIG. 8 shows a central processing unit 252 as well as a print head processing unit 270. The tangible memory 251, 254, 272 can be volatile memory (e.g., registers, cache, RAM), non-volatile memory (e.g., ROM, EEPROM, flash memory, etc.), or some combination of the two, accessible by the processing unit(s). The memory stores software implementing one or more printer control functions, in the form of computer-executable instructions suitable for execution by the processing unit(s).

A computing system can have additional features. For example, the computing system can include remote memory, one or more input devices 256, one or more output devices 258, and one or more communication connections. An interconnection mechanism (not shown) such as a bus, controller, circuit or network interconnects the components of the computing system. Operating system software (not shown) can be included to provide an operating environment for other software executing in the computing system, and can coordinate the activities of the components of the computing system.

The tangible storage 251, 254, 272 can be removable or non-removable, and can include magnetic disks, magnetic tapes or cassettes, CD-ROMs, DVDs, or any other medium which can be used to store information in a non-transitory way and that can be accessed within the computing system.

The innovations can be described in the general context of computer-readable media that store the computer executable instructions. Computer-readable media are any available tangible media that can be accessed within a computing environment. By way of example, and not limitation, with the computing system of the printer, computer-readable media include memory 251, 252, and 272, and combinations of any of the above.

The innovations can be understood in the general context of computer-executable instructions, such as those included in program modules, being executed in a computing system on a target real or virtual processor. Generally, program modules include, but are not limited to, routines, programs, libraries, objects, classes, components, data structures, lookup tables, etc. that perform particular tasks or implement particular abstract data types. The functionality of the program modules can be combined or split between program modules as desired in various embodiments. Computer-executable instructions for program modules can be executed within a local or distributed computing system.

The terms "system" and "device" are used interchangeably herein. Unless the context clearly indicates otherwise, neither term implies any limitation on a type of computing system or computing device. In general, a computing system or computing device can be local or distributed, and can include any combination of special-purpose hardware and/or general-purpose hardware with software implementing the functionality described herein.

For the sake of presentation, the detailed description uses terms like "determine" and "use" to describe computer operations in a computing system. These terms are high-level abstractions for operations performed by a computer, and should not be confused with acts performed by a human being. The actual computer operations corresponding to these terms vary depending on implementation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

Any of the disclosed methods can be implemented as computer-executable instructions stored on one or more computer-readable storage media (e.g., non-transitory computer-readable media, such as one or more optical media discs, volatile memory components (such as DRAM or SRAM), or nonvolatile memory components (such as hard drives)) and executed on a computer. Any of the computer-executable instructions for implementing the disclosed techniques as well as any data created and used during implementation of the disclosed embodiments can be stored on one or more computer-readable media (e.g., non-transitory computer-readable media). The computer-executable instructions can be part of, for example, a dedicated software application or a software application that is accessed or downloaded via a web browser or other software application (such as a remote computing application). Such software can be executed, for example, on a single local printer computer. For clarity, only certain selected aspects of the software-based implementations are described. Other details that are well known in the art are omitted. For example, it should be understood that the disclosed technology is not limited to any specific computer language or program. For instance, the disclosed technology can be implemented by software written in C++, Java, Perl, JavaScript, Adobe Flash, or any other suitable programming language. Likewise, the disclosed technology is not limited to any particular computer or type of hardware. Certain details of suitable computers and hardware are well known and need not be set forth in detail in this disclosure.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

Any of the storing actions described herein can be implemented by storing things described as stored in one or more computer-readable media (e.g., computer-readable storage media or other tangible media).

Also, any of the methods described herein can be implemented by computer-executable instructions stored and/or encoded in one or more computer-readable storage devices and/or tangible media (e.g., memory, magnetic storage, optical storage, or the like). Such instructions can cause a computer to perform the method.

If the message to be printed on the substrate, such as the label design, requires a quantity of print data to print that exceeds the capacity of the print head controller memory 272, some of the message may be truncated during printing if the print data is not properly handled. In such cases, as well as otherwise when desired, the block of print data required to print the entire label (the term label is used for convenience as it is to be understood that the term label encompasses any substrate printing task) can be subdivided into sub-blocks that do not exceed the memory capacity of the print head controller. Although less desirable, the subdivision into the sub-block mode of operation can also be implemented even if the print head memory is sufficiently large to store print data for the entire message. These sub-blocks of data can then be delivered to the print head in succession with one sub-block being printed on the label, followed by the printing of the next sub-block, and so forth. The end result is a label with individually printed sub-blocks that are in effect stitched together or joined on the resulting finished label. By backing up the substrate a back distance and then in effect overprinting the backed up area of the substrate with corresponding data when printing the next sub-block, smoother transitions in printing between sub-blocks of data can be achieved. That is, a first sub-block of data can be printed with the substrate traveling in a downstream direction, the substrate travel can then be reversed to travel upstream for a back distance, and a second sub-block of data can then be printed on the substrate traveling in a downstream direction. The data being printed onto the back distance or back space area, as the substrate travels in the downstream direction and the back distance again passes the thermal print head, corresponds to the data printed from the preceding sub-block of data onto the back distance portion of the substrate. By corresponding, it is meant that the data applied to the print back distance portion during the subsequent printing of the back distance is preferably identical to the data printed during the preceding printing of the back distance portion. However, it is to be understood that some deviation from print data identity is permissible that does not result in significant visually detracting artifacts in the transition region. For example, during reprinting of the overlap area as the substrate is moved in the downstream direction, only a selected portion of the originally printed data can be used for printing the back distance or overlap area.

Figure 9:
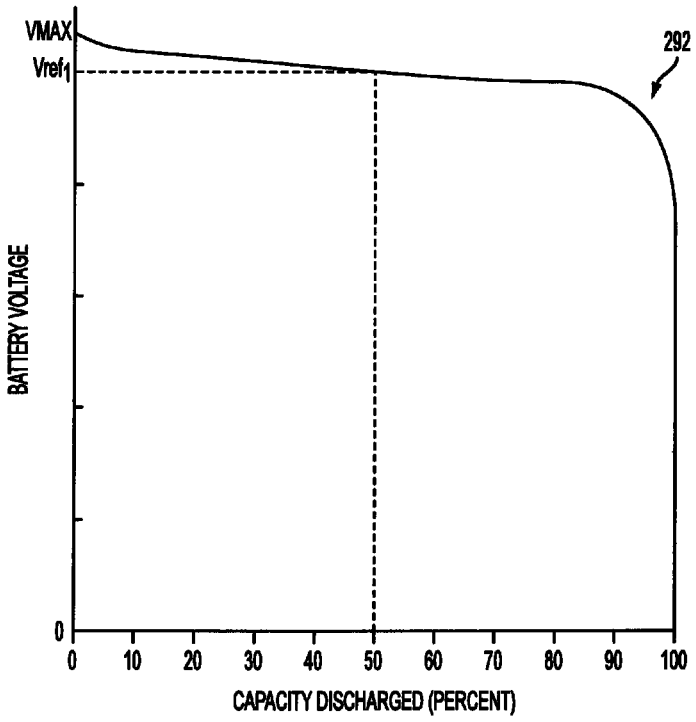
FIG. 9 is an exemplary battery discharge curve showing the sharp discharge that occurs at a knee portion of the curve where the battery voltage starts to drop rapidly toward zero.

FIG. 9 illustrates an exemplary battery curve for a conventional battery, such as a lithium ion battery. For example, the initial voltage Vmax can be up to about 25 volts for a 24 volt rated battery. As the battery discharges during use, initially the battery drops at a very slow rate. For example, in FIG. 9 when the battery is 50% discharged from its useful voltage, the battery voltage has dropped to $Vref_1$ that may, for example, be about 23 volts. When the battery is about 90% discharged, it begins to reach a knee 292 of the battery discharge curve (at about 21 volts). At the knee the battery voltage drops very rapidly as the final charge on the battery is used. Assume the battery of FIG. 9 is connected to a print head element of a print head for delivering energy to the print head element. When the battery is 10% discharged, the power delivered to the print element (power $P=V\times I$ (where V is the voltage and I is the current) is at a higher level than when the battery is 50% discharged and the voltage is $Vref_1$. However, to deliver the same amount of energy to the print head element under these conditions, one can, for example, increase the time that the power is applied to print head elements when the battery is operated at or under 50% discharge conditions in comparison to the amount of time power is applied to the print head elements when the battery is at the 10% discharge condition. Thus, for example, the energy set points can be varied to change the amount of time the battery is coupled to the print head elements in response to dropping battery voltage. This can be done in discrete steps. For example, a different energy setting can be used when the voltage is at Vref (that increases the time power is applied) than when the energy setting for battery voltage at the 10% discharged level. A lookup table can be used with the appropriate energy settings for one or more such steps in voltage levels. The change in energy settings can also be calculated. Alternatively, a continuous adjustment of the delivered energy can be accomplished in response to signals corresponding to voltage changes.

Figure 10:
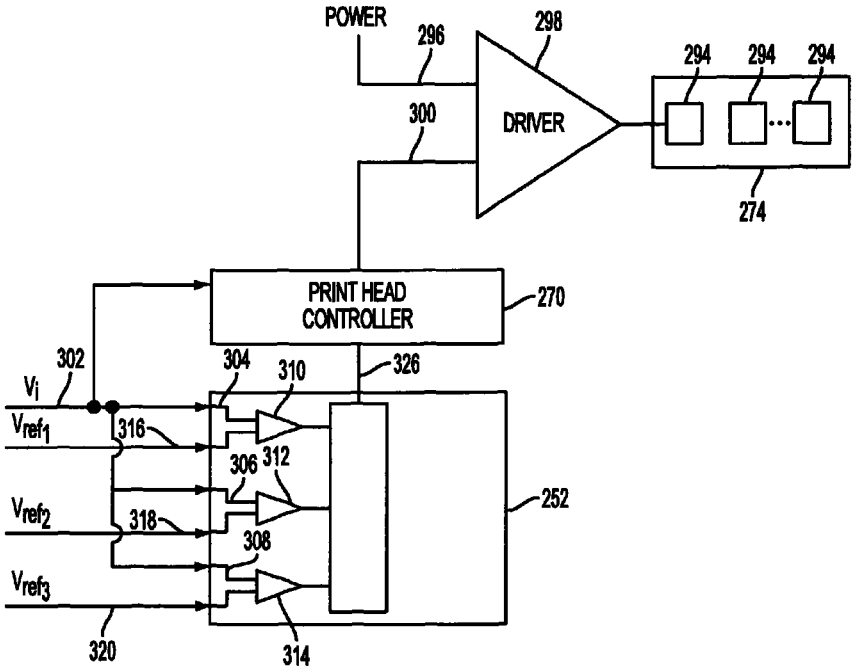
FIG. 10 and FIG. 11 illustrate exemplary embodiments of energy selection approaches for varying the energy provided to heating elements of a print head in response to changes in power resulting from changes in voltages from a power source coupled to the print head.

With reference to FIG. 10, a print head 274 is illustrated with a plurality of print head pixel heating elements being indicated at 294 in this figure. Power from a power source, such as a battery, is coupled to one input 296 of a conventional print head heating element driving circuit 298. The other input of print head driver 298 is coupled to an output of the print head controller 270 (or alternatively to an output of CPU 252 (FIG. 8)) in this example. A control signal on line 300 selectively turns the driver on to deliver power from the power source to the print head element. A similar circuit can be used for each of the print head pixel heating elements. The duration of the on signal on line 300 is variable in response to control signals. In FIG. 10, an input $V_i$, corresponding to the voltage level of a battery (if a battery is the printer power source), is fed to respective inputs 304, 306 and 308 of associated comparators 310, 312 and 314. A first reference signal $Vref_1$ is fed to another input 316 of comparator 310, a second reference signal $Vref_2$ is fed to a second input 318 of comparator 312 and a third reference signal $Vref_3$ is fed to an input 320 of the comparator 314. $Vref_1$ can correspond to $Vref_1$ in FIG. 9. $Vref_2$ can correspond to another voltage to which the battery is discharged (such as 80% discharged) and $Vref_3$ can correspond to a low voltage (e.g., 20 volts) below which the printer can be shut off or switched to an alternative power source if available (e.g., replacing the battery, plugging in a battery charger to an A/C power source, etc.). These comparisons can be performed by circuits or in software with inputs being provided to processor 252 as respective digital inputs. As the signal $V_i$ reaches $Vref_1$ (e.g., drops below voltage $Vref_1$), the output from comparator 310 changes. In response, the control signal on line 326 from processor 252 to the print head controller 270 can change to an increased power setting, resulting in a change in the control signal at line 300 to cause the operation of driver 298 to increase the energy being provided to the print head heater elements. Similarly, if assuming a plural step adjustment is provided, if the signal $V_i$ reaches $Vref_2$ (e.g., drops below $Vref_2$) the output signal from comparator 312 changes. As a result, the processor 252 can change the control signal on line 326 to a further increased power setting, resulting in a further change to the signal on line 300 to again change the operation of driver 298 to increase the delivered energy. If on the other hand, the signal $V_i$ reaches $Vref_3$ (e.g., drops below $Vref_3$) the output from comparator 314 changes. If $Vref_3$ is the minimum voltage level below which the printer is to be shut down, in response processor 252 can provide a signal on line 326 to interrupt the delivery of power to the print head and shut the printer off (e.g., power to the print head elements can be interrupted). In one specific illustrative embodiment, only two energy settings are provided for each specific ink transfer ribbing/substrate combination.

Figure 11:
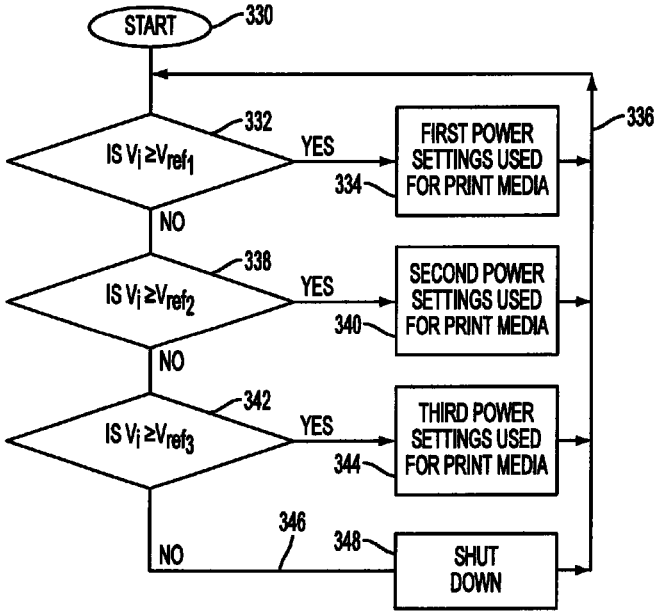

FIG. 11 illustrates this exemplary process in greater detail. From a start block 330, a block 332 is reached at which a determination is made as to whether $V_i$ is greater than or equal to $Vref_1$. If the answer is yes, a block 334 is reached and the first power settings are used (such as from a lookup table) for the ink transfer ribbon and print media. The process loops back via path 336 to block 332 and is repeated as long as $V_i$ is not less than $Vref_1$. $Vref_1$ thus comprises an exemplary threshold voltage. As pointed out above, the threshold could in effect be slightly above $Vref_1$ in which case when $Vref_1$ is reached, the loop is followed to block 334 as the threshold would then be slightly above $Vref_1$. If the printer is in a battery mode of operation and is discharging over time as printing takes place, eventually the answer at block 332 is expected to be no, meaning that $V_1$ is less than $Vref_1$ in this example. In this case a block 338 is reached and a determination is made as to whether $V_i$ is greater than or equal to $Vref_2$ (while being less than $Vref_1$). If the answer is yes, a block 340 is reached and a second set of power settings is used for printing on the print media with increased energy. The loop follows path 336 back to block 332 and, unless the battery has been replaced or recharged, block 338 will again be reached and this loop will continue. Eventually the signal $V_i$ may drop below $Vref_2$, for example, to a level at or above $Vref_3$. In this case, a block 344 is revealed and a third set of power settings is used to again increase the delivered energy. Any number of threshold settings can be used, such as N threshold settings. In the illustrated example, if $V_i$ drops below $Vref_3$, a path 346 is reached, which corresponds to a voltage below the minimum allowed voltage for printing in this example. Path 346 is followed to block 348 indicating the printer is shut down (e.g., power is no longer delivered to the print head heating elements, but other printer components can remain powered such as a display). The process continues via path 336 with the printing being off until such time as the voltage from the power source increases to a value in this example that is at or above $Vref_3$.

Figure 12:
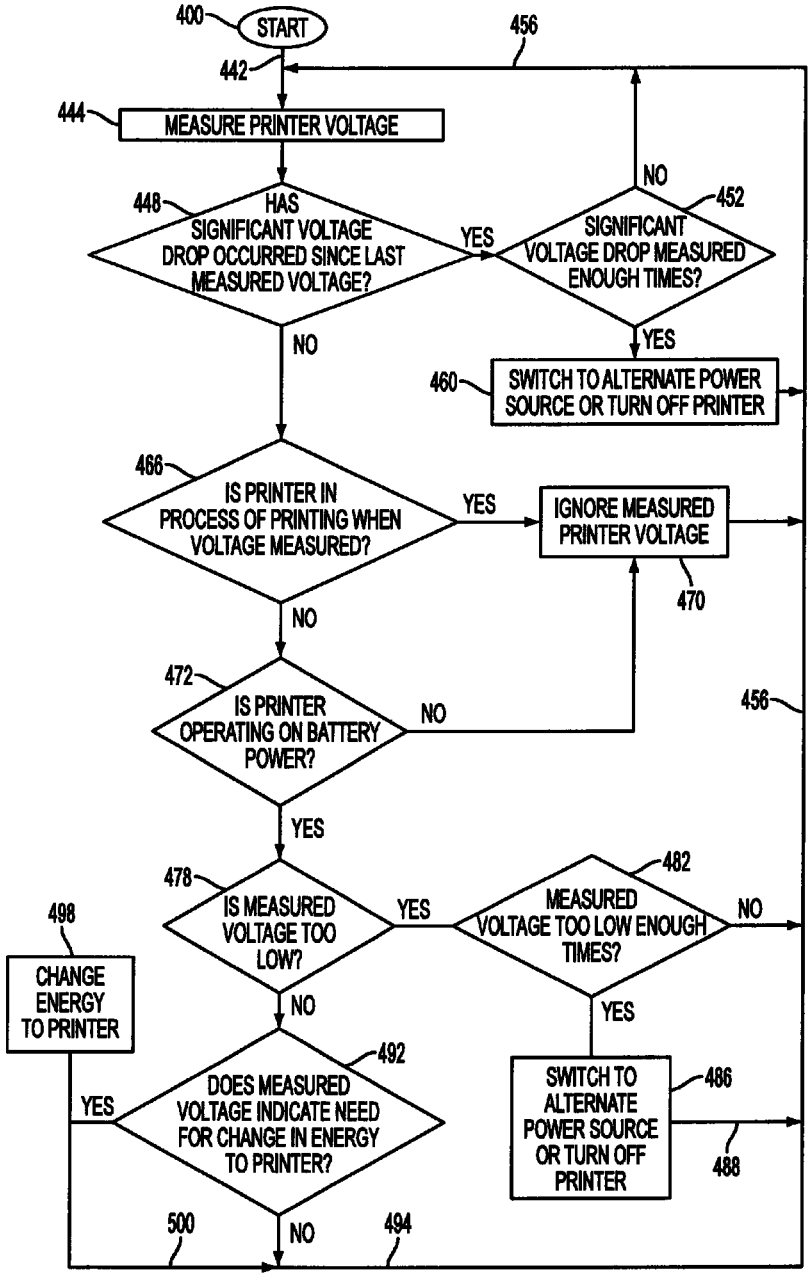
FIG. 12 is a schematic illustration of an exemplary control approach for a printer based on changes in voltage from a power source.

FIG. 12 illustrates an exemplary control methodology for controlling a printer to adjust energy delivered to print elements of the print head of a thermal printer in response to changes in signals corresponding to the voltage of a battery. In FIG. 12, and the description below, the reference to voltage is to be understood to mean signals corresponding to the voltage which can be current, voltage or power related signals. In FIG. 12, from a start block 400 a path 442 is followed to a block 444. At block 444, the printer voltage (the voltage of a battery source powering the printer) is measured. Measurement can be accomplished by digital sampling, or otherwise. The voltage can be from an alternative source, such as an electrical power grid. However, when a printer is powered from the grid, the grid voltage can be assumed to remain substantially constant such that the changes in energy delivered to print head elements becomes unnecessary. From block 444, a path is followed to a block 448. At block 448 a determination is made as to whether a significant voltage drop has occurred since a last measured voltage. For example, a determination is made as to whether a battery is approaching the knee 292 (FIG. 9) of the battery discharge curve. For example, in a nominal 24 volt battery, this fast drop of voltage can start to occur at or near about 21 volts. If the answer is yes, a yes branch path is followed to a block 452. At block 452 a determination is made as to whether a significant voltage drop has been measured enough times. For example, it is possible that a spurious measurement has taken place. Rather than reacting to spurious measurements, the significant voltage drop can be required to occur more than once before reacting to the drop. If the answer at block 452 is no, a no path is followed to a path 456 and the process returns to block 444 and continues. If the answer at block 452 is yes, a yes path is followed to a block 460. At block 460 the printer is switched to an alternative power source (e.g., plugged in to recharge the battery, the battery is replaced, or power to print head elements is turned off). The process can then continue via path 462 to the path 456 and back to block 444.

In contrast, if at block 448 the answer is no, meaning that significant voltage drops have not occurred, a path is followed to a block 466. At block 466 a determination is made as to whether the voltage was measured when the printer was in the process of printing. As previously mentioned, when under battery power the battery voltage typically drops, for example, by as much as 1.5 volts, when the printer is actually printing. Following printing the battery then typically returns to a value that is slightly less than the value before the printing took place. In this example, it is desirable to ignore changes in voltage levels during printing of a print. If the energy settings were adjusted based on measurements of voltage changes during printing, they could end up to be too high when the next print is made. A signal can be provided to the processor to indicate printing has taken place (such as when a user pushes a start print button), and/or or the processor can internally determine this condition based on the status of internal control signals that control the start of printing. If the answer at block 466 is yes, a path is followed to a block 470 indicating that changes in the measured printer voltage are to be ignored and/or filtered out under these conditions. The process returns via pathway 456 to block 444. On the other hand, in this example if at block 466 the answer is no, meaning the measurement is not during a time period when the printer is printing, a block 472 is reached, at which a determination is made as to whether the printer is operating on battery power. This can be done in a number of ways. For example, one can monitor whether the current being supplied to the printer is flowing along a pathway from an external source or from a battery source. Alternatively, a switch can be moved to provide a signal if battery power is being used. As yet another example, for a given printer the maximum voltage of the battery is known. If the voltage drops more than a certain amount (such as a percentage or amount, that can be predetermined), from the maximum voltage, one can assume that a battery is being used as the power source as the voltage level from the electrical power grid can be assumed to remain essentially constant. As a specific example, one can assume a battery is being used if the measured voltage is less than some percentage, such as 75% of the maximum usable battery voltage or at or below a designated voltage level. For example, and not to be construed as a limitation, assume that for a nominal 24 volt voltage, the voltage usable to make quality prints is from 21.5 volts to 25 volts. An assumption can be made that battery power is being used if the voltage is at or below 23.5 volts. If the answer at block 472 is no, a path is followed to block 470 and the measured printer voltage is ignored and/or filtered out. In this case the measured voltage is high enough to not require any changes in energy settings. If at block 472 the answer is yes, a path is followed to a block 478.

At block 478 a determination is made as to whether the measured voltage is too low. This can, for example, be the minimum voltage at which the printer is to be kept on (e.g., delivery of energy to the print head is blocked so that printing is off). For a nominal 24 volt battery, this can, for example, be at about 20 volts. If the answer at block 478 is yes, a path is followed to a block 482 and a determination is made as to whether the measured voltage has been too low enough times. Like previously discussed block 452, this allows the system to ignore spurious low voltage measurements. That is, by requiring the measured voltage to be too low (below the minimum level) enough times to ensure the measurements are accurate, the printer will not be shut down in response to a spurious signal. From block 482, if the answer is yes, a path is followed to a block 486. At block 486 the printer is shifted to an alternate power source or turned off. From block 486 a path 488 is followed to the pathway 456 and the process returns to block 444. In contrast, if the answer at block 478 is no, this indicates that the voltage is in a range that is high enough to produce acceptable quality prints. In this case, from block 478, a path is followed to a block 492. At block 492 a determination is made as to whether the measured voltage has changed enough to indicate a need for a change in the energy delivered to the print head of a printer. If the answer at block 492 is no, a no branch path 494 is followed to the path 456 and the process returns to block 444. If the answer at block 492 is yes, a path 496 is followed to block 498 and the energy delivered to the print head of the printer is changed. For example, the energy settings for printing are changed to increase the energy delivered to the print head elements. From block 498 a path 500 is followed to the path 456 and the process returns to block 444.

It should be noted that one or more of the steps or acts indicated in FIG. 12 can be eliminated. For example, one can go directly from block 444 to block 466 and then to block 492 with the steps associated with blocks 448, 472 and 478 eliminated. In addition, the steps or acts need not be performed in the order indicated in FIG. 12.

Figure 13:
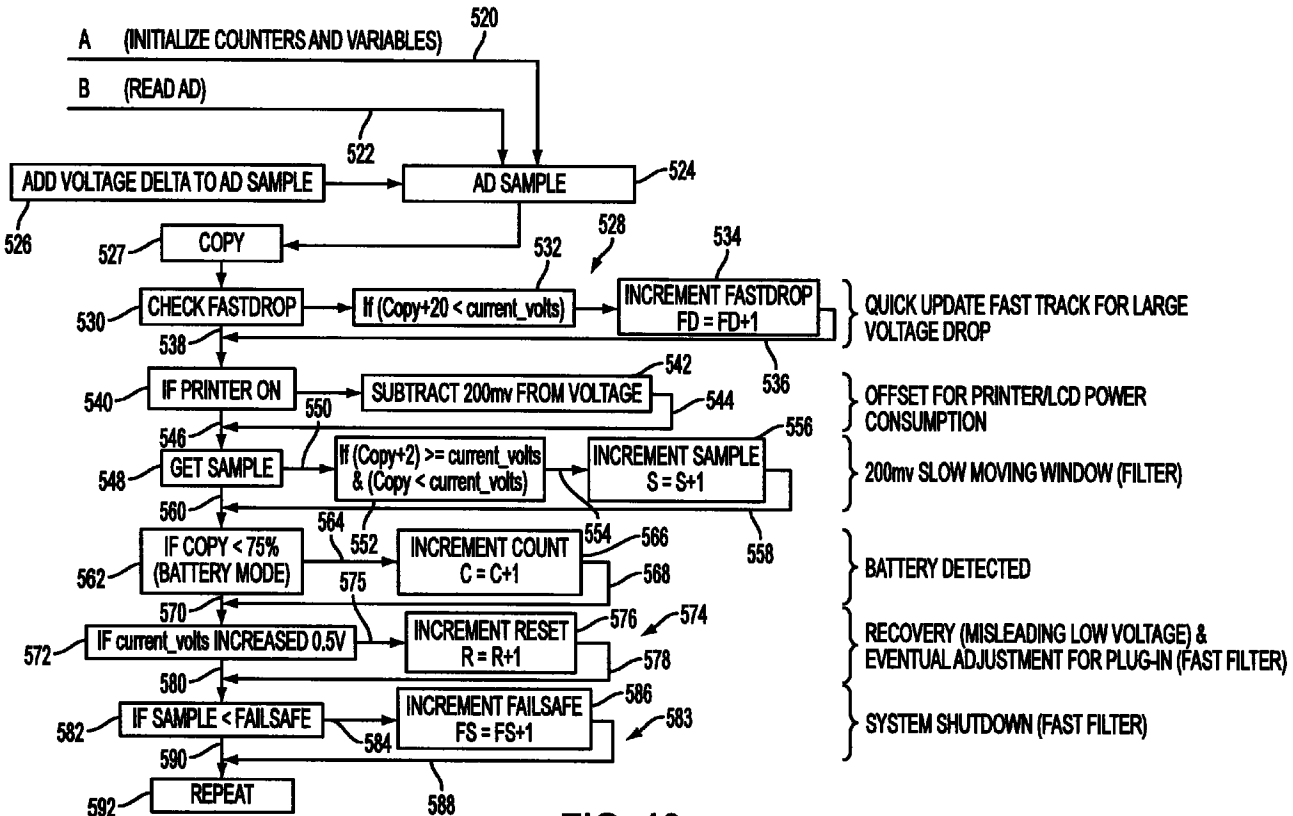
FIG. 13 and FIG. 14 schematically illustrate a more specific example of an approach for controlling the energy provided to a print head in the face of variations in signals corresponding to the voltage available from a power source.
Figure 14:
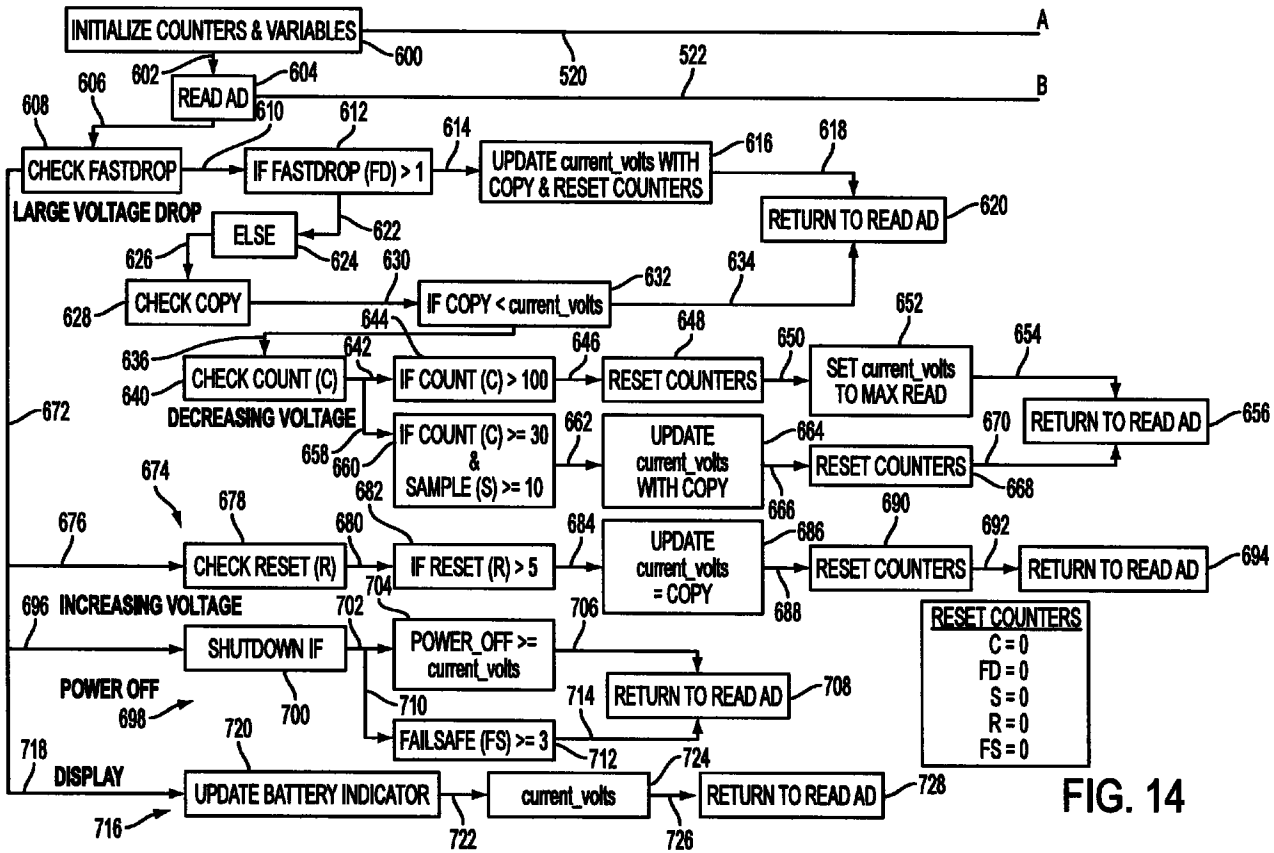

FIG. 13 and FIG. 14 illustrate a more detailed and specific example of computer implemented processes that can be used to control the operation of the printer to control printing and vary the energy delivered to print head heating elements of the printer. In the example of these figures, FIG. 13 illustrates an exemplary interrupt loop that can be periodically run to determine whether conditions exist that warrant a change in energy delivery to a print head. Thus, for example, the process illustrated at FIG. 13 can be run as an interrupt process to the process shown in FIG. 14 every 500 milliseconds (every 0.5 second). Before starting the process, counters and variables are initialized. For example, the expected battery voltage can be 24 volts for a 300 watt printer (such a battery can have a voltage of up to about 25 volts). A voltage divider (e.g., a divide by 5 divider) can be used to reduce the magnitude of sample voltages to, for example, five volts as the maximum voltage. During initialization of the variables, the value of the variable current_volts can be set to an initial value of, for example, four and one-half volts (24 volts divided by 5). In addition, the various counters can be set to respective initial values such as zero. These counters in this example can include a fast drop counter with a fast drop count FD initially set to zero; a battery mode counter with its initial count C set to zero; a sample counter with its count S initially set to zero; a reset counter with its count R initially set to zero; and a failsafe counter with its initial count set to zero.

During the running of the interrupt loop, a signal corresponding to the voltage level of the power source of the printer is read via line 522 to provide a digital sample value of this signal at 524. Thus, at block 524 a determination is made of a signal corresponding to the present value of the voltage from the power source. If desired, this present signal value can be adjusted by a calibration factor Δ via a block 526, as is explained below in connection with FIG. 15. Since the characteristics of print heads and other components in a printer can vary, calibration of various print heads of a particular model of print head helps to ensure that each printer of the model produces prints that are consistent with prints from other printers of the model. Calibration is, however, optional. The calibrated signal, if calibration is used, is one form of a signal that corresponds to the present value of the voltage from the power source. At block 527, a Copy of this present value signal is stored and, for purposes of this description, is named "Copy". From block 527, a fast drop checking sub-loop 528 is reached. Sub-loop 528 checks for rapid dropping of voltages, such as can take place when a battery charge approaches the knee of the battery discharge curve (see 292 of FIG. 9). Thus, from block 527 a block 530 is reached at the start of the check fast drop sub-loop. At block 532 a determination is made if the quantity "Copy plus twenty" is less than current_volts. In this exemplary block 532, 20 refers to 2.0 volts (100 millivolts per each integer increment).

Thus in block 532 the question involves determining whether the Copy value is more than two volts less than the stored current_volts value. A different figure other than two volts can be used to indicate a fast drop condition, but this is a convenient example. Two volts is above a maximum 1.5 volt drop expected during printing of a print (a drop of 0.5 to 1.5 volts typically occurs during printing) in one exemplary printer so that, in this example, printing of a print would not typically trigger a fast drop determination. If the answer at block 532 is yes, at block 534 the fast drop counter is incremented by one. More specifically, the fast drop count FD is set equal to FD plus one. The process then returns by way of a path 536 to path 538 and to a block 540. At block 540, a determination can be made as to whether the printer is on but not printing a print at the time of the AD sample obtained at block 524. If the answer is no, a block 542 is reached and 200 millivolts is subtracted from the voltage (from the Copy value) in this example. A 200 millivolt offset (or another other offset voltage if selected or designated) provides an offset for a sleep mode during which certain printer components that normally draw current are inactive, such as an LCD display. This option acts as a tool to make voltage determinations consistent whether the printer is in a sleep mode or in on mode wherein these components draw current. If the printer is on so that these components are drawing current, in this example the 200 millivolt offset is not subtracted. From block 542 a path 544 is followed to a path 546 and a block 548 is reached. At block 548 a determination is made as to whether a sample (present value signal) is to be obtained and stored. A sample is desirably not obtained in this example if the printer is printing a print when the signal corresponding to the present voltage was determined. From block 548 a path 550 is followed to a block 552. At block 552 a determination is made as to whether the Copy value plus two (plus 200 millivolts) is greater than or equal to the current_volts value and the Copy value is less than the stored current_volts value. In this example, samples are obtained if the printer is not printing a print when the voltage determination is made, if the voltage changes have been relatively slow, and if the voltage has dropped from the stored current_volts value. The voltage is expected to drop over time when a battery is used to power a printer to print prints. If these conditions are met, a path 554 is followed to a block 556. At block 556, the sample counter count S is incremented by one. That is, S is set equal to S plus one in this example. A path 558 is followed to a path 560. From path 560, a block 562 is reached at which a determination is made as to whether a battery is being used to power the printer. It is assumed in this example that a battery is being used if the value of Copy is less than 75% of a maximum value that corresponds to a maximum voltage. As previously mentioned, the battery mode operation can be determined in other ways. From block 562, if the printer is in the battery mode, a path 564 is followed to a block 566. At block 566 a count C (battery mode counter) is incremented. That is, a count C is set equal to C plus one. A path 568 is followed from block 566 to a path 570 and to a block 572. Block 572 is a part of a sub-loop 574 that is followed if the adjustment of the current_volts value (as a result of the main loop discussed below in connection with FIG. 14) has increased by at least 0.5 volts. This provides an exemplary mechanism for adjusting the current_volts value in the event a value for a misleading low voltage value has been stored for the current_volts value. If current_volts has increased by 0.5 volts from a prior value of the current_volts, from block 572 a block 576 is reached via a path 575 and a reset count R is incremented. That is, R is set equal to R plus one. A path 578 is followed to a path 580 to a block 582. Block 582 relates to a sub-loop 583 at which a determination is made as to whether a possible shut down voltage condition has been reached. If the value of the sample obtained in block 548 is less than a failsafe threshold or value, from block 582 a path 584 is followed to a block 586. At block 586 the fail safe counter is incremented by changing the fail safe value FS to equal FS plus one. From block 586 a path 588 is followed to a path 590 and a block 592 is reached. At block 592, the process of FIG. 13, starting with block 524 is repeated by reading the analog digital converter coupled to line 522 of FIG. 14 when the next interrupt poll is to take place.

With reference to FIG. 14, the exemplary main processing loop of an exemplary embodiment for adjusting the energy provided to print head heating elements of a thermal printer print head will be understood. At a block 600, the counters and variables are initialized as previously described with initial signals being sent via a path 520 to the interrupt routine of FIG. 13. A path 602 is followed to a block 604 at which an analog to digital converter is read to determine or obtain a present value signal that corresponds to the voltage of the power source then being applied or available to apply to the print head of the printer. Path 522, leading to the interrupt routine of FIG. 13 is also shown coupled to the read AD block 604.

From block 604, a path 606 is followed to a block 608 indicated as a check fast drop block. One subroutine indicated by this block can check to determine whether fast drop conditions exist in the voltage corresponding to the determined present value signal. From block 608 a path 610 is followed to a block 612 at which a determination is made as to whether the fast drop count is greater than a threshold. In this example, a check is made as to whether the fast drop count FD is greater than one. If the answer is yes, a path 614 is followed to a block 616. At block 616 the current_volts value is updated (replaced with) the Copy value and the counters are reset. From block 616 a path 618 is followed to a block 620 which returns the process to block 604 at which the analog to digital converter value is again read.

If the fast drop at block 612 is not greater than one in this example (a value greater than one indicates a relatively quick rate of change), a path 622 is followed to an Else block 624 and from there via a path 626 to a check copy block 628. The check copy block 628 refers to a subroutine wherein a determination is made as to whether voltage is decreasing as expected for valid signals when a battery is being used for printing. From block 628 a path 630 is followed to a block 632. At block 632 a determination is made as to whether the Copy value is less than current_volts. If the answer is no, a path 634 is followed to the block 620 and the process returns to reading the analog to digital converter value at block 604. If the answer at block 632 is yes, a path 636 is followed to a block 640 at which a check count subroutine is accomplished. From block 640 along a path 642, a block 644 is reached, at which a determination is made as whether the battery mode count C is greater than one hundred. This condition is normally not met unless the printer is being used to make multiple copies. For example, if the interrupt is occurring at a rate of once every half second (every 500 milliseconds), the earliest the count can go from zero to more than one hundred is over fifty seconds. If the count C is over one hundred, from block 644 a path 646 is followed to a block 648 at which the counters are reset. From block 648 a path 650 is followed to a block 652 and the value of current_volts is set equal to the maximum value read from the AD converter at block 604 since the counters were previously reset. From block 652 a path 654 is followed to a block 656 and a return is made to block 604 with the analog to digital converter again being read to determine a present signal value.

If at the check count block 640 the count is not greater than one hundred, a branch 658 is followed to a block 660. At block 660 a determination is made whether the count C is greater than or equal to thirty AND the sample count S is greater than or equal to ten. If these conditions are met, it means that the voltage has been decreasing slowly. In addition, rather than updating values with every sample, filtering is taking place by delaying the updates until enough counts C and samples S have occurred/taken place. If the conditions at block 660 are met, a path 662 is followed to a block 664 and the current_volts value is updated with the Copy value. In other words, the Copy value becomes the new or updated current_volts value. From block 664 a path 666 is followed to a block 668 at which the counters are reset. A path 670 is followed from block 688 to the block 656 and the process continues at block 604.

An alternative path 672 to the path 610 leads from check fast drop block 608. From this path an increasing voltage detection sub-loop 674 is reached. That is, from path 672 by way of a path 676 a block 678 is reached at which the reset value R is checked. From block 678, via a path 680, a block 682 is reached. At block 682, a determination is made as to whether the reset count R is greater than a value, such as five. If the answer is yes, a path 684 is followed to a block 686 and the current_volts value is replaced or updated with the Copy value. From block 686, a path 688 is followed to a block 690 at which the counters are reset. From block 690 via a path 692 a block 694 is reached which returns the process to block 604 at which the analog to digital converter is again read. If the answer at block 678 is no, the block 700 can be reached.

Another branch 696 is also shown coupled to the branch or path 672. The path 696 relates to a power shut off subroutine or sub-loop 698. From path 696, a block 700 is reached at which a determination is made as to whether the printer should be shut off (e.g. power to the print head turned off). At block 700 a path 702 leads to a block 704 at which a determination is made as to whether a POWER_OFF value, corresponding to a power indicating that the print head should no longer be powered to print prints, is greater than or equal to the current_volts value. If the answer to this is yes, the processor can shut down printing by the printer as the current_volts value is less than a minimum threshold power level. From block 704 via a path 706 a block 708 is reached and the process returns to block 604 with the analog to digital converter again being read. The printer will remain in a shut down mode until such time as power is supplied from an alternative source (e.g., a new battery), from an electrical grid, or the battery is recharged to an acceptable level. An alternative shut down condition can be reached from block 700 and path 702 via a path 710 to a block 712. If the fail safe count FS is greater than or equal to three, indicating that three fail safe voltage signal corresponding determinations have been made by the interrupt loop of FIG. 13, the processor can also shut down printing by the printer. From block 712 a path 714 is followed to the block 708. If the shutdown conditions via sub-loop 698 are not met, the process can continue, such as via sub-loop 716.

A display adjust sub-loop 716 can also be included in the process. In this sub-loop, a path 718 from the path 672 reaches a block 720 at which a battery indicator of a display is updated. That is, from block 720 via a path 722 a block 724 is reached at which the display is updated to display the current_volts value. From block 724, by way a path 726, a block 728 is reached and process returns to block 604 with the analog to digital converter again being read to determine the present value of the signal corresponding to the voltage of the power source being used for the printer.

Figure 15:
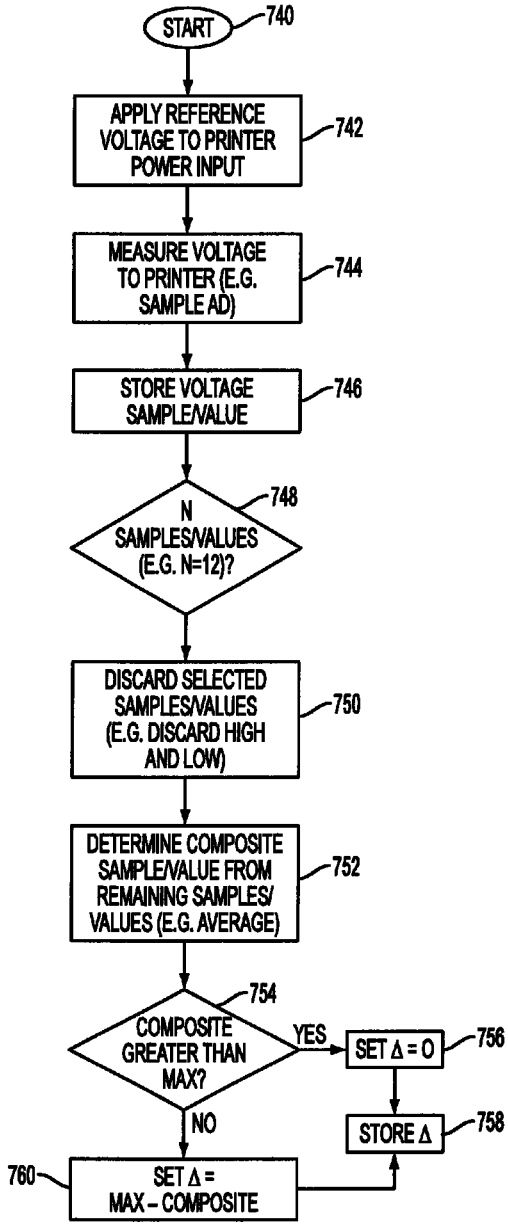
FIG. 15 is a schematic illustration of one approach for calibrating the voltage signals to account for variations in performance between different printers.

FIG. 15 illustrates an exemplary approach for calibrating a printer and determining a Δ value (see block 527 in FIG. 13). From a start block 740, a block 742 is reached at which a known reference voltage is applied to a printer power input. The same reference voltage can be used for all printers of the same model, or for printers of different models, for calibration purposes. At block 744, a signal corresponding to the applied reference voltage is measured (e.g., the analog to digital value obtained when the reference voltage is applied is determined at block 604 (FIG. 14)). At block 746 a corresponding digital sample value is stored. At block 748 a determination is made as to whether enough sample values have been obtained, in this case N sample values. For example N can be set equal to 12. The sample values can be obtained, for example, at the same sampling rate as the interrupt process of FIG. 13 operates (e.g., every 500 milliseconds). From block 748 the process reaches a block 750 at which some filtering takes place. For example, selected sample values can be discarded such as the highest and lowest values. At block 752 a composite sample value is obtained from the remaining sample values following the filtering, if filtering is used. For example, an average of these values can be used. Alternatively, a mean value can be used. It should be noted that block 750 is an optional filtering step as all the values can be used. From block 752, of a block 754, a determination is made as to whether the composite value is greater than a maximum value. If the composite value is greater than a value corresponding to the expected maximum voltage value a block 756 can be reached and Δ set equal to zero. The value Δ can then be stored at block 758 and used to adjust the sample values determined at block 524 in FIG. 13 as the interrupt loop is being run. If the composite value is not greater than the maximum value, a block 760 is reached and Δ is set equal to the "maximum value minus the composite value." This determined Δ is then stored at block 758 and used as previously explained. By setting Δ equal to zero in the event the composite value is greater than the maximum value, this provides for convenient computations as negative Δ values are avoided.

Throughout this disclosure, when a reference is made to the singular terms "a", "and", and "first", it means both the singular and the plural unless the term is qualified to expressly indicate that it only refers to a singular element, such as by using the phrase "only one". Thus, for example, if two of a particular element are present, there is also "a" or "an" of such element that is present. In addition, the term "and/or" when used in this document is to be construed to include the conjunctive "and", the disjunctive "or", and both "and" and "or". In the case of a list of more than two items with the phrase "and/or" between the next to last and last item of the list, the term "and/or" means any one or more or all of the items on the list in all possible combinations and sub-combinations. Also, the term "includes" has the same meaning as comprises.

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "and", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the term "includes" has the same meaning as comprises.

Throughout this application references are made to a threshold. It is to be understood that terms such as "greater than" or "equal" to a threshold are also met when the threshold is approached. For example, assume a purported threshold is stated to be a value A. Assume changes are being made at a level slightly above A. The level slightly above A will thus be the threshold, and the value A would be a value at or below the threshold.

Having illustrated and described the principles of our invention with reference to a number of embodiments, it should be apparent to those of ordinary skill in the art that the embodiments may be modified in arrangement and detail without departing from the inventive principles disclosed herein. We claim as our invention all such embodiments as fall within the scope of the following claims.

We claim:

1. A method of operating a thermal print head of a printer to print a substrate comprising:

determining a signal value corresponding to the battery voltage of a battery operable to supply energy to the thermal print head and storing a signal value corresponding to the determined signal value as a stored signal value;

changing the energy delivered from the battery to the thermal print head in response to changes in the stored signal value, the act of changing the energy delivered comprises selectively increasing the energy delivered from the battery to the thermal print head in response to the stored signal value changing from a signal value corresponding to the battery voltage at a level above a threshold battery voltage to a signal value corresponding to the battery voltage at or below the threshold battery voltage.

2. A method according to claim 1 wherein the act of changing the energy delivered comprises selectively decreasing the energy delivered from the battery to the thermal print head in response to the stored signal value changing from a signal value corresponding to the battery voltage at or below the threshold battery voltage to a signal value corresponding to the battery voltage level above the at least one threshold battery voltage.

3. A method according to claim 1 wherein there are at least first and second threshold battery voltages, the act of changing the energy delivered comprises selectively increasing the energy delivered from the battery to the thermal print head in response to the stored signal value changing from a signal value corresponding to the battery voltage at a level above the first threshold battery voltage to a signal value corresponding to the battery voltage at or below the level of the first threshold battery voltage;

wherein the act of changing energy delivered comprises selectively decreasing the energy delivered from the battery to the thermal print head in response to the stored signal value changing from a signal value corresponding to the battery voltage at or below the first threshold battery voltage to a signal value corresponding to the battery voltage above the first threshold battery voltage;

wherein the act of changing the energy delivered comprises selectively increasing the energy delivered from the battery to the thermal print head in response to the stored signal value changing from a signal value corresponding to the battery voltage at or below the first threshold battery voltage to a signal value corresponding to the battery voltage at or below a second threshold battery voltage; and wherein the act of changing the energy delivered comprises selectively decreasing the energy delivered from the battery to the thermal print head in response to the stored signal value changing from a signal value corresponding to the battery voltage at or below the second threshold battery voltage to a signal value corresponding to the battery voltage above the second threshold battery voltage.

4. A method according to claim 1 comprising turning off the delivery of energy to the thermal print head in response to the stored signal value changing from a signal value corresponding to the battery voltage at a level that is above a power off threshold battery voltage to a signal value corresponding to the battery voltage at or below the power off threshold battery voltage.

5. A method according to claim 1 wherein the act of selectively changing the energy delivered comprises not changing the energy delivered in the event the signal value is determined during a time the thermal print head is printing a print.

6. A method according to claim 1 wherein the act of selectively changing the energy delivered comprises not changing the energy delivered when the printer is powered by a source other than the battery.

7. A method according to claim 1 comprising the act of increasing the rate of change of the stored signal value in response to decreases in the determined signal value that occur at a rate that is greater than a fast drop rate.

8. A method of operating a thermal print head of a printer to print a substrate comprising:

determining a determined digital signal value that corresponds to the voltage of a power source coupled to the thermal print head, the power source being operable to supply energy to the thermal print head;

storing at least one stored digital signal value corresponding to the voltage of the power source at a time prior to the time of determining the determined digital signal value;

comparing the determined digital signal value to the stored digital signal value;

selectively changing the value of the stored digital signal value in response to the comparison; and selectively increasing the energy delivered from the power source to the thermal print head in response to the comparison if the stored digital signal value corresponds to a voltage of the power source that is at or below a first threshold value of voltage.

9. A method according to claim 8 in which the act of selectively increasing the energy delivered comprises determining if the power source is a battery and not increasing the energy delivered from the power source to the thermal print head if the power source is not a battery.

10. A method according to claim 8 in which the act of selectively changing the value of the stored digital signal value comprises not changing the stored digital signal value if the determined digital signal value is determined during a time in which the thermal print head is printing a print.

11. A method according to claim 8 in which the act of selectively changing the value of the stored digital signal comprises decreasing the value of the stored digital signal at a first rate of decrease if the determined digital signal value has decreased at a one rate relative to the stored digital signal value, and decreasing the value of the stored digital signal at a second rate of decrease if the determined digital signal value is decreasing at another rate that is greater than the one rate, the second rate being greater than the first rate.

12. A method according to claim 11 in which the act of selectively changing the value of the stored digital signal comprises increasing the value of the stored digital signal if the determined digital signal value is increasing at a rate of increase that is at least equal to a first rate of increase rate.

13. A method according to claim 12 comprising the act of interrupting the supply of energy to the thermal print head if the determined digital signal value is less than a value corresponding to a minimum voltage level.

14. A method according to claim 8 comprising the act of interrupting the supply of energy to the thermal print head if the determined digital signal value is less than a value corresponding to a minimum voltage level.

15. A method according to claim 8 wherein the act of determining a digital signal value comprises obtaining a digital signal value from an analog to digital converter that receives an input corresponding to the voltage of a power source coupled to a thermal print head, periodically sampling the determined digital signal value to provide a digital sample value and adding a digital calibration signal value to the digital sample value to determine the determined digital signal value that corresponds to the voltage of the power source coupled to the thermal print head.

16. A method of operating a thermal print head to print a substrate comprising:

repetitively performing acts comprising A through F below:

A. obtaining a digital signal sample value for a sampling time, the digital signal sample value corresponding to the voltage of a power source coupled to the thermal print head;

B. comparing the digital signal sample value obtained for one sampling time with a stored digital signal sample value for prior sampling time prior to the said one sampling time, and incrementing a fast drop count if the digital signal sample value for said one sampling time is less than the stored digital signal sample value by a fast drop value;

C. incrementing a sample count if the digital signal sample value for the one sampling time is not obtained during a time that the thermal print head is printing a print and the digital signal sample value for the one sampling time is less than the stored digital signal sample value;

D. incrementing a battery mode count if the digital signal sample value for the one sampling time is less than a first predetermined battery mode operation indicating value;

E. incrementing a reset count if the digital signal sample value for the one sampling time has increased by more than a predetermined amount over the stored digital signal value;

F. incrementing a fail safe count if the digital signal sample value for the one sampling time corresponds to a voltage of the power source that is less than a fail safe value;

repetitively performing the acts comprising G through L below:

G. determining a digital signal value that corresponds to the voltage of the power source coupled to the thermal print head;

H. turning off power to the thermal print head if (i) a power-off value is greater than or equal to the stored digital signal sample value; or (ii) the fail safe count from act F is greater than or equal to a maximum fail safe count; and (iii) returning to act G;

I. if the reset count from act E is greater than a maximum reset count, then: (i) replacing the stored digital signal sample value with the digital sample value for said one sample time; (ii) and resetting the fail safe count, the reset count, the battery mode count, the sample count and the fast drop count to respective initial values; and returning to act G;

J. if the fast drop count from act B is greater than a maximum fast drop count; then: (i) replacing the stored digital signal sample value with the digital sample value for said one sample time; and (ii) returning to act G;

K. if the fast drop count from act B is not greater than the maximum fast drop count and the digital signal sample value for said one sampling time is not less than the stored digital signal sample value, then: return to act G;

L. if the fast drop count is not greater than the maximum fast drop count and the digital sample value obtained for said one sampling time is less than the stored digital signal sample, then: (i) if the battery mode count from act D is greater than a maximum battery mode count, resetting the fail safe count, the reset count, the battery mode count, the sample count and fast drop count to respective initial values and replacing the stored digital signal sample with the highest determined digital signal value that is determined since the previous resetting of the battery mode count that is less than the stored digital signal sample value and return to act G; or (ii) if the battery mode count from act D is greater than or equal to an update indicating value battery mode count that is less than the maximum battery mode count and the sample count from act C is greater than or equal to a maximum sample count, replacing the stored digital signal sample value with the digital signal sample value for said one sampling time and resetting the fail safe count, the reset count, the battery mode count, the sample count and the fast drop count to their respective initial values and return to act G.

17. A thermal printer for transferring ink from an ink transfer ribbon to a substrate, energy from a battery or other power source being provided to a print head of the printer to selectively heat elements of the print head to transfer ink from the ink transfer ribbon to the substrate to print the substrate, the printer comprising:

a computer processor comprising an input for receiving a present value signal corresponding to the voltage of the power source;

the computer processor comprising memory that stores a signal value corresponding to the received present value signal, the memory storing at least one stored signal value corresponding to the voltage of the power source at a time prior to the receipt of the present value signal;

the computer processor comparing the present value signal to said at least one stored signal value and selectively changing the stored signal value to a stored updated signal value based upon the comparison;

the computer processor controlling the energy delivered to the print head from the power source based upon the comparison to selectively increase the energy delivered to the print head if the stored updated signal value changes from corresponding to a battery power source voltage above a first threshold to correspond to a battery power source voltage that is at or below the first threshold.

18. A thermal printer according to claim 17 wherein the printer has a non-battery mode of operation in which energy is provided to the print head from a power source other than a battery, wherein if the present value signal corresponds to a voltage that is not less than a battery mode threshold voltage, the computer processor controls the energy delivered to the print head so as to not selectively increase the energy delivered to the print head.

19. A thermal printer according to claim 17 wherein the computer processor receives an input signal indicating the printer is printing a print, the computer processor controlling the energy delivered to the print head so as to not increase the energy delivered to the print head in response to changes in the present value signal due to printing of a print.

20. A thermal printer according to claim 17 wherein the computer processor changes the stored signal value to a stored updated signal value by decreasing the stored signal value at a first rate of decrease if the present value signal has decreased at a one rate relative to the stored signal value, and by decreasing the stored signal value at a second rate of decrease if the present value signal is decreasing at another rate that is greater than the one rate, the second rate being greater than the first rate.

21. A thermal printer according to claim 17 wherein the computer processor changes the stored signal value to a stored updated signal value by increasing the stored signal value if the present value signal is increasing at a rate of increase that is at least equal to a first rate of increase rate.

22. A thermal printer according to claim 21 wherein the computer processor is operable to control the interruption of the supply of energy to the thermal print head if the present value signal corresponds to a voltage that is less than a minimum voltage threshold.

23. A thermal printer according to claim 17 wherein the computer processor is operable to control the interruption of the supply of energy to the thermal print head if the present value signal corresponds to a minimum voltage threshold.

24. A thermal printer according to claim 17 comprising an analog to digital converter that receives an input corresponding to the voltage of the power source coupled to a thermal print head, the computer processor periodically reading the analog to digital converter value to provide digital sample values and adding a digital calibration signal value to the digital sample values to provide present value signals that correspond to the voltage of the power source coupled to the thermal print head.

* * * * *